US009896298B2

(12) United States Patent
Yoshida et al.

(10) Patent No.: US 9,896,298 B2
(45) Date of Patent: Feb. 20, 2018

(54) APPARATUS AND METHOD FOR CUTTING SHEET

(71) Applicant: CANON KABUSHIKI KAISHA, Tokyo (JP)

(72) Inventors: Masahito Yoshida, Shiki (JP); Tetsuhiro Nitta, Yokohama (JP); Kota Uchida, Kawasaki (JP); Takayuki Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 14/927,234

(22) Filed: Oct. 29, 2015

(65) Prior Publication Data

US 2016/0046459 A1 Feb. 18, 2016

Related U.S. Application Data

(62) Division of application No. 12/965,734, filed on Dec. 10, 2010, now abandoned.

(30) Foreign Application Priority Data

Apr. 6, 2010 (JP) ..... 2010-087892

(51) Int. Cl.
*B26D 5/20* (2006.01)
*B65H 35/06* (2006.01)
(Continued)

(52) U.S. Cl.
CPC ..... *B65H 35/06* (2013.01); *B26D 1/085* (2013.01); *B26D 5/28* (2013.01); *B26D 7/08* (2013.01); *B65H 43/00* (2013.01); *B65H 2301/51212* (2013.01); *B65H 2404/14* (2013.01); *B65H 2511/51* (2013.01); *B65H 2513/10* (2013.01); *B65H 2513/108* (2013.01); *B65H 2513/40* (2013.01); *B65H 2801/06* (2013.01); *Y10T 83/0405* (2015.04); *Y10T 83/2022* (2015.04); *Y10T 83/4529* (2015.04)

(58) Field of Classification Search
CPC ..... B26D 5/20; B26D 5/02; B26D 11/008; B65H 2513/108
USPC ..... 83/236, 110; 270/176, 202, 270
See application file for complete search history.

(56) References Cited

U.S. PATENT DOCUMENTS 2,156,049 A * 4/1939 Boerger ..... B23D 33/00 83/156
3,768,349 A * 10/1973 Cauffiel ..... B23D 33/02 83/209

(Continued)

*Primary Examiner* — Kenneth E Peterson
(74) *Attorney, Agent, or Firm* — Canon U.S.A., Inc. IP Division

(57) ABSTRACT

A sheet is cut between a first conveying unit and a second conveying unit in a state in which the first and second conveying units halt and in which an upstream conveying unit conveys the sheet at a first speed; after the sheet is cut, the first conveying unit conveys the sheet at a second speed higher than the first speed to reduce a slack formed during the halting; after the sheet is cut, the second conveying unit conveys the downstream-side sheet at a third speed higher than the first speed; if the third conveying unit is nipping the sheet during cutting, the third conveying unit conveys the sheet at the third speed; and if the third conveying unit is not nipping the sheet, the third conveying unit conveys the sheet at the third speed or a fourth speed after the detecting unit detects the sheet.

14 Claims, 24 Drawing Sheets

(51) Int. Cl.

| | |
|---|---|
| ***B26D 1/08*** | (2006.01) |
| ***B26D 5/28*** | (2006.01) |
| ***B26D 7/08*** | (2006.01) |
| ***B65H 43/00*** | (2006.01) |

(56) References Cited

U.S. PATENT DOCUMENTS 4,184,392 A * 1/1980 Wood ..... B23F 5/28
271/203
4,480,516 A * 11/1984 Leroy ..... A61F 13/15723
83/110
4,655,067 A * 4/1987 Frost ..... B23D 33/02
72/131
4,860,619 A * 8/1989 Yunoki ..... A41H 37/06
29/33.2
5,199,341 A * 4/1993 Jones ..... B26D 1/385
83/100
5,301,578 A * 4/1994 Fromson ..... B26D 5/00
83/214
6,003,420 A * 12/1999 Wakabayashi ..... B26D 9/00
83/214
6,418,825 B1 * 7/2002 Hartmann ..... B65H 20/02
83/110
7,430,948 B2 * 10/2008 De Marco ..... B65H 20/22
83/236
7,871,074 B2 * 1/2011 Yamasaki ..... B65H 5/062
271/265.01
8,157,261 B2 * 4/2012 Oota ..... B65H 5/062
271/176
8,731,453 B2 * 5/2014 Inoue ..... G03G 15/6564
271/270
8,919,232 B2 * 12/2014 Kozasa ..... B23K 26/0846
83/236

* cited by examiner

APPARATUS AND METHOD FOR CUTTING SHEET

CROSS-REFERENCE TO RELATED APPLICATIONS

This application is a Divisional Application of U.S. patent application Ser. No. 12/965,734, filed Dec. 10, 2010, now abandoned, which claims the benefit of Japanese Patent Application No. 2010-087892 filed Apr. 6, 2010. Each of U.S. patent application Ser. No. 12/965,734 and Japanese Patent Application No. 2010-087892 is hereby incorporated by reference herein in its entirety.

BACKGROUND OF THE INVENTION

Field of the Invention

The present invention relates to an apparatus and method for cutting a sheet for use in an image forming apparatus capable of obtaining cut sheet products by supplying a continuous sheet.

Description of the Related Art

In known image forming apparatuses capable of obtaining cut sheet products from a continuous sheet, a plurality of processes are performed including image formation and cutting from sheet supply to completion. The sheet is subjected to various processes while being conveyed, in which the sheet conveying speed are changed from one process to another.

In particular, in conventional upstream and downstream processes including a cutting process, it is necessary to change the conveying speed or to stop the conveyance depending on the situation due to differences in processing speed required in halting the sheet for cutting and in the upstream and downstream processes.

A photo-printing apparatus disclosed in Japanese Patent Laid-Open No. 1-99049 is provided in view of the problem that, in the flow of printing a sheet, cutting the sheet, and conveying the sheet to a developing process, the conveying speed is low and constant, while at the printing process, the conveying speed is high and intermittent. Japanese Patent Laid-Open No. 1-99049 discloses a method for coping with the difference in conveying speed by providing a conveying-speed adjusting unit capable of controlling the nip and separation of the sheet behind the cutting unit, instead of a conventional loop-like storage portion.

In this type of image forming apparatus, the need for enhancing the performance, such as increasing the speed and reducing the size, is always present as an object, also the need for apparatus specifications, such as controlling the conveying speed by easily coping with mixture of products of different lengths as a requirement.

SUMMARY OF THE INVENTION

The present invention provides, among other things, a sheet cutting apparatus in which slack in a sheet generated at halting of the sheet during cutting can be quickly removed, and even if the length of the sheet to be cut varies, a conveying unit can be driven depending on the length.

According to an aspect of the present invention, there is provided a sheet cutting apparatus including a first conveying unit that conveys a sheet; an upstream conveying unit that is disposed upstream in the conveying direction of the first conveying unit and that conveys the sheet at a first conveying speed; a first cutting unit that is disposed downstream in the conveying direction of the first conveying unit and that cuts the sheet; a second conveying unit that is disposed downstream in the conveying direction of the first cutting unit and that conveys the sheet; a third conveying unit that is disposed downstream of the second conveying unit and that conveys the sheet; and a detecting unit that is disposed between the second conveying unit and the third conveying unit and that detects the sheet. The first cutting unit cuts the sheet in a state in which the first conveying unit and the second conveying unit are halting and the upstream conveying unit is conveying the sheet at the first conveying speed; and after the sheet is cut, the first conveying unit conveys the sheet at a second conveying speed higher than the first conveying speed to reduce the slack of the sheet formed between the upstream conveying unit and the first conveying unit during the halting; and after the sheet is cut, the second conveying unit conveys the cut sheet at the downstream side at a third conveying speed higher than the first conveying speed; after the sheet is cut, if the third conveying unit is nipping the sheet during cutting of the sheet, the third conveying unit conveys the sheet at the third conveying speed, and if the third conveying unit is not nipping the sheet during cutting of the sheet, the third conveying unit is driven to convey the sheet at the third conveying speed or a fourth conveying speed after the detecting unit detects the sheet.

Further features of the present invention will become apparent from the following description of exemplary embodiments with reference to the attached drawings.

DESCRIPTION OF THE EMBODIMENTS

Inkjet printers according to various example embodiments of the present invention will be described hereinbelow. The printers of the embodiments are high-speed line printers that use a continuous roll sheet. The printers are suitable for the field of apparatuses that print a large quantity of sheets used in, for example, printing companies.

First Embodiment

Figure 1:
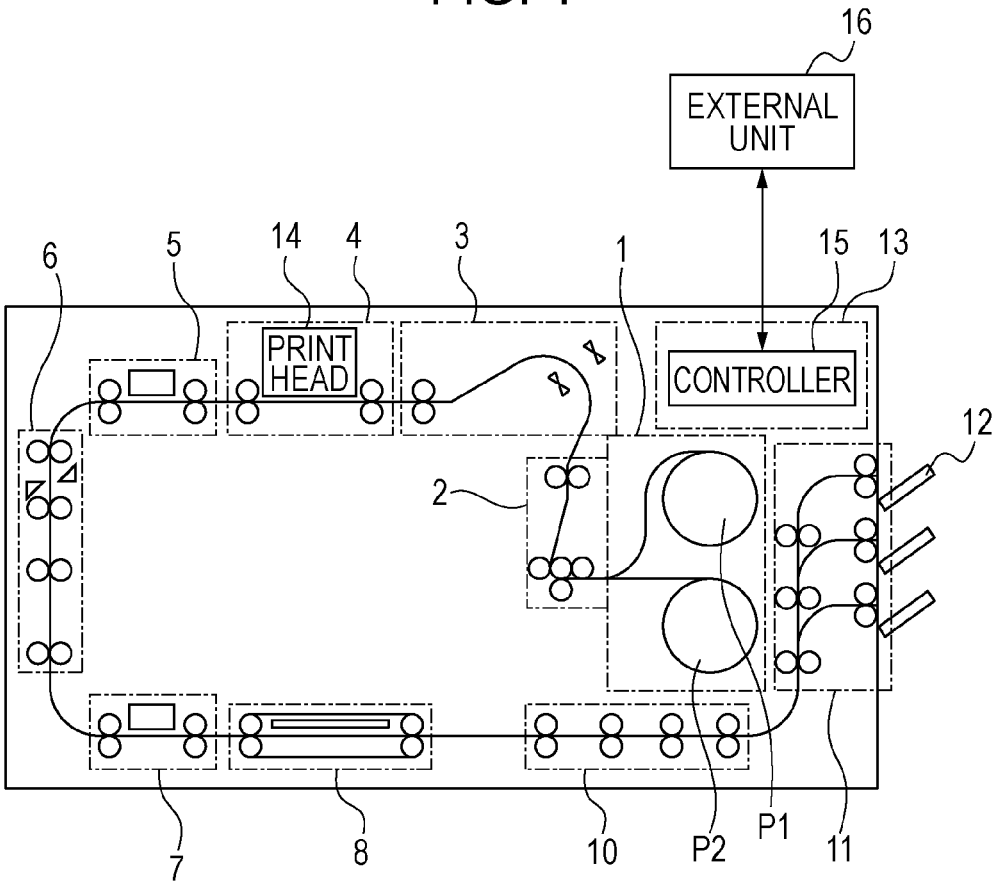
FIG. 1 is a schematic sectional view illustrating the internal configuration of a printer that accommodates a sheet cutting and conveying mechanism according to an embodiment of the present invention.

FIG. 1 is a schematic sectional view illustrating the internal configuration of a printer that accommodates a sheet cutting and conveying mechanism according to an embodiment of the present invention. The printer roughly accommodates a sheet supplying unit 1, a decurling unit 2, a skew straightening unit 3, a printing unit 4, a checking unit 5, a cutting unit 6, an information recording unit 7, a drying unit 8, a discharge conveying unit 10, a sorting unit 11, a discharging unit 12, and a control unit 13. A sheet is conveyed by a conveying mechanism including roller pairs and a belt along the sheet conveying path indicated by the solid line in the drawing and is processed by the individual units.

The sheet supplying unit 1 is a unit that accommodates and supplies a continuous roll sheet. The sheet supplying unit 1 can accommodate two rolls P1 and P2 and is configured to selectively draw and supply a sheet. The number of rolls accommodated is not limited to two; it may be one or three or more.

The decurling unit 2 is a unit that reduces the curl (warping) of a sheet supplied from the sheet supplying unit 1. The decurling unit 2 reduces the curl by curving the sheet so as to give warping opposite the curl using two pinch rollers per one driving roller.

The skew straightening unit 3 is a unit that straightens the skew (inclination relative to an original advancing direction) of the sheet that passed through the decurling unit 2. The skew of the sheet is straightened by pushing a reference end of the sheet against a guide member.

The printing unit 4 is a unit that forms an image on the conveyed sheet using a print head 14. The printing unit 4 further includes a plurality of conveying rollers that convey the sheet. The print head 14 has line print heads in which an inkjet nozzle array is formed in a range that covers the supposed maximum width of the sheet. The print head 14 is configured such that the plurality of print heads are arranged in parallel along the conveying direction. The inkjet system can employ a system that uses heating elements, a system that uses piezoelectric elements, a system that uses electrostatic elements, a system that uses MEMS elements, etc. Color inks are supplied from ink tanks to the print head 14 through respective ink tubes.

The checking unit 5 is a unit that checks the state of the nozzles of the print heads, the sheet conveying state, image positions, etc. by optically reading a check pattern or image printed on the sheet by the printing unit 4.

The cutting unit 6 is a unit equipped with a mechanical cutter that cuts the printed sheet into a predetermined length. The cutting unit 6 also has a plurality of conveying rollers for forwarding the sheet to the next process and a space for storing waste generated by cutting.

The drying unit 8 is a unit that heats the sheet printed by the printing unit 4 to dry applied ink in a short time. The drying unit 8 is also equipped with a heater, a conveying belt for forwarding the sheet to the next process, and a conveying roller.

The discharge conveying unit 10 is a unit that conveys the sheets that are cut by the cutting unit 6 and dried by the drying unit 8 to the sorting unit 11. The sorting unit 11 is a unit that divides the printed sheets into groups and may discharge them into different trays of the discharging unit 12.

The control unit 13 is a unit that controls the components of the entire printer. The control unit 13 includes a CPU 601, a memory, a controller 15 equipped with various I/O interfaces, and a power source. The operation of the printer is controlled on the basis of an instruction from the controller 15 or an external unit 16, such as a host computer, connected to the controller 15 via an I/O interface.

Figure 2:
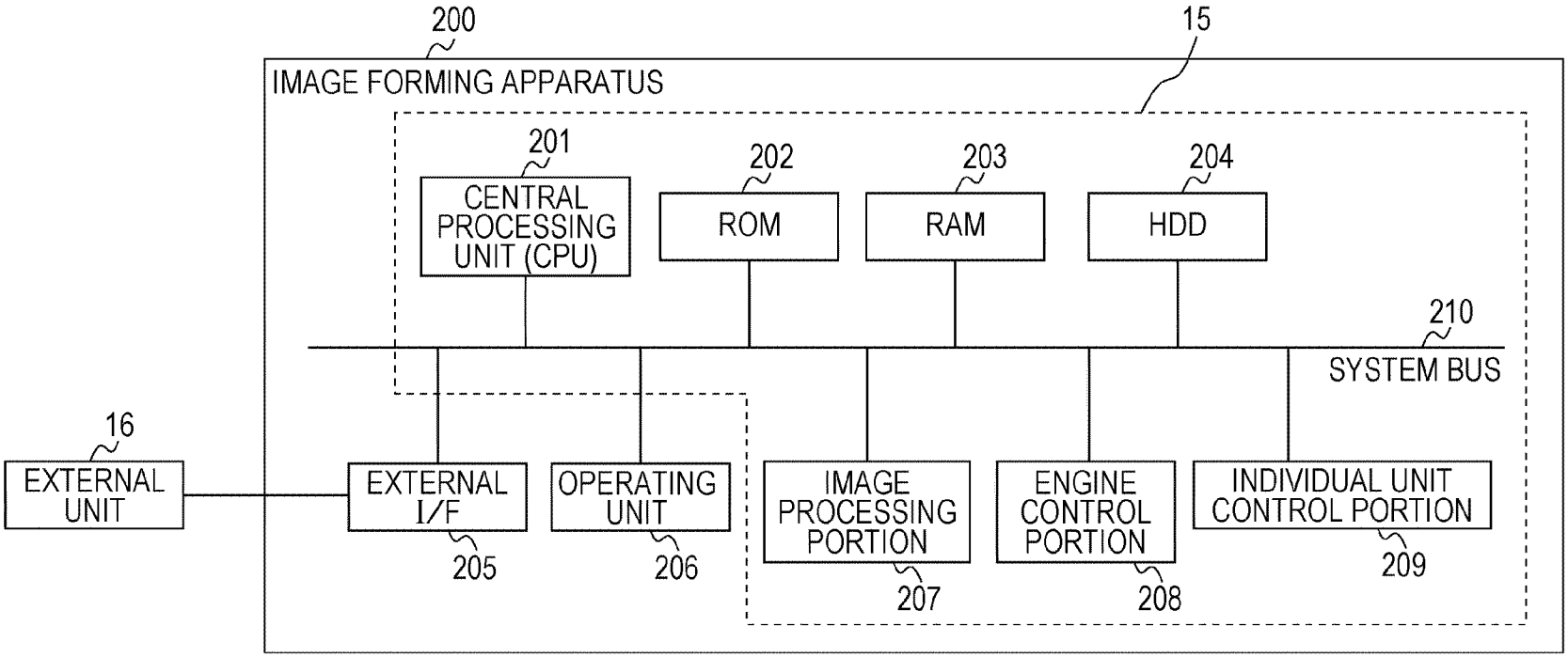
FIG. 2 is a block diagram illustrating a control unit.

FIG. 2 is a block diagram illustrating the control unit 13. The controller 15 (enclosed by the broken line) included in the control unit 13 is constituted by a CPU 201, a ROM 202, a RAM 203, a HDD 204, an image processing portion 207, an engine control portion 208, and an individual-unit control portion 209. The CPU 201 (central processing unit) integrally controls the operations of the individual units of the printer. The ROM 202 stores programs for the CPU 201 to execute and fixed data for the various operations of the image forming apparatus. The RAM 203 is used as a work area of the CPU 201 or a temporary storage of various received data or is used to store various set data. The HDD 204 (hard disk) can store and read programs for the CPU 201 to execute, print data, and set information for the various operations of the image forming apparatus. The operating unit 206 is an input/output interface with a user and includes an input unit, such as a hard key and a touch panel, and an output unit, such as a display that presents information and a voice generator.

Units that require high-speed data processing are provided with dedicated processing units. The image processing portion 207 performs image processing of print data handled by the image forming apparatus. The image processing portion 207 converts the color space (for example, YCbCr) of input image data to a standard RGB color space (for example, sRGB). The image data is subjected to various image processings, such as resolution conversion, image analysis, and image correction. Print data obtained through those image processings is stored in the RAM 203 or the HDD 204. The engine control portion 208 controls driving of the print head 14 of the printing unit 4 in accordance with print data on the basis of a control command received from the CPU 201 or the like. The engine control portion 208 further controls the conveying mechanisms for the components in the image forming apparatus 200. The individual-unit control portion 209 is a subcontroller for individually controlling the sheet supplying unit 1, the decurling unit 2, the skew straightening unit 3, the checking unit 5, the cutting unit 6, the information recording unit 7, the drying unit 8, the reversing unit 9, the discharge conveying unit 10, the sorting unit 11, and the discharging unit 12. The operations of the individual units are controlled by the individual-unit control portion 209 on the basis of an instruction of the CPU 201. The external interface 205 is an interface (I/F) for connecting the controller 15 to the external unit 16, which is a local I/F or a network I/F. The above components are connected by a system bus 210.

The external unit 16 is a unit that serves as the source of image data for the image forming apparatus to perform printing. The external unit 16 may be either a general-purpose or dedicated computer or a dedicated imaging device, such as an image capture, a digital camera, and a photostorage having an image reader. If the external unit 16 is a computer, an OS, application software for generating image data, and a print driver for the image forming apparatus are installed in a storage included in the computer. It is not essential to implement the foregoing processes using software; part or all of the processes may be implemented using hardware.

Figure 3:
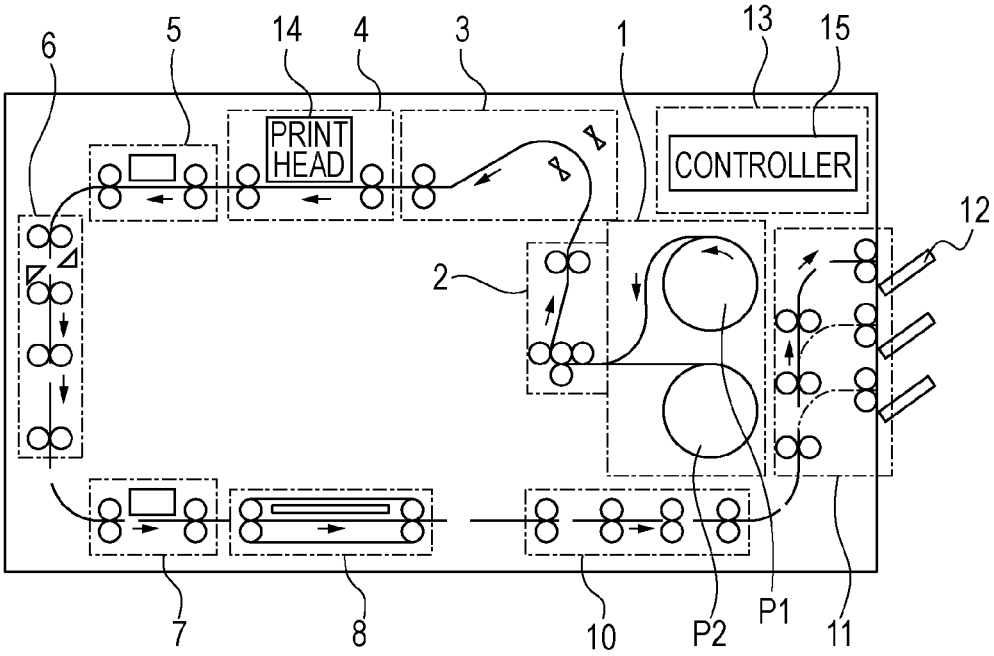
FIG. 3 is a schematic diagram illustrating the operation of the printer accommodating the sheet cutting and converting mechanism according to an embodiment of the present invention.

FIG. 3 is a schematic diagram illustrating the operation of the printer accommodating the sheet cutting and converting mechanism according to an embodiment of the present invention. A conveying path through which a sheet supplied from the sheet supplying unit 1 is printed and is then discharged to the discharging unit 12 is indicated by a bold line. The sheet supplied from the sheet supplying unit 1 is processed by the decurling unit 2 and the skew straightening unit 3. The front surface (first surface) of the sheet is printed by the printing unit 4. Images of a predetermined unit length (unit images) in the conveying direction are printed on a long continuous sheet in sequence to form a plurality of images in a line. The printed sheet passes through the checking unit 5 and is cut into unit images of a predetermined length by the cutting unit 6. Print information may be recorded on the back of the cut sheets that are cut every image by the information recording unit 7. The cut sheets are conveyed to the drying unit 8 one by one and are dried. Thereafter, the cut sheets are sequentially discharged to the discharging unit 12 of the sorting unit 11 through the discharge conveying unit 10 and are stacked. On the other hand, a sheet left at the printing unit 4 side after the cutting of the last unit image is fed back to the sheet supplying unit 1 and is rolled back by the roll P1 or P2.

The cutting unit 6 that is the sheet cutting and conveying mechanism of the printer with the above configuration according to an embodiment of the present invention will be described in more detail.

In the first embodiment, an example in which only one cutter is used will be described.

Figure 4:
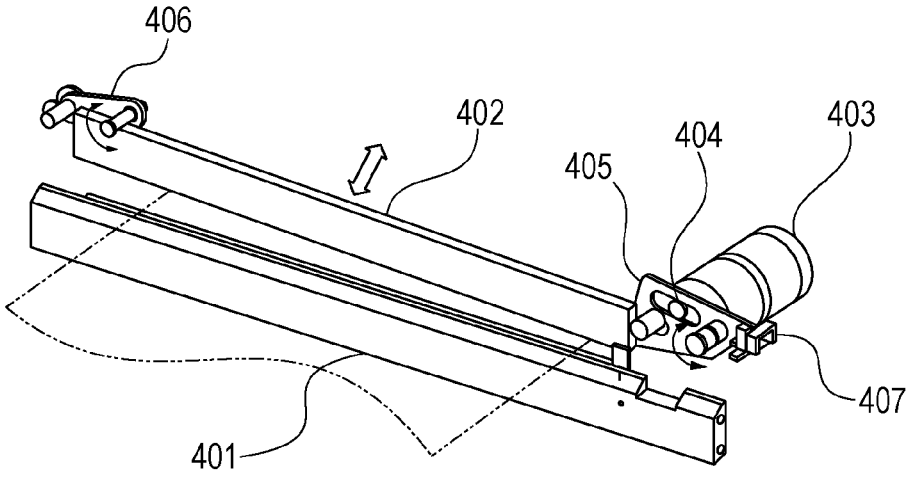
FIG. 4 is a schematic diagram illustrating the configuration of a cutter included in the sheet cutting and conveying mechanism according to an embodiment of the present invention.

FIG. 4 is a schematic diagram illustrating the configuration of a cutter that is a cutting unit included in the sheet cutting and conveying mechanism according to an embodiment of the present invention. The cutter is of generally called a sliding type and is constituted by a fixed blade 401 and a movable blade 402. The movable blade 402 is driven by a cutter motor 403 serving as a driving source via a cam 404, a driving-side link 405, and a driven-side link 406 to move vertically in contact with the fixed blade 401 at an angle. Since a load during cutting is large, a DC motor is used as the cutter motor 403. A cutter sensor 407 detects the top dead center of the movable blade 402 and stops the movable blade 402 by means of a short-circuit brake that directly couples both terminals of the DC motor in accordance with detection timing, achieving a high-speed vertical reciprocating movement.

Figure 5:
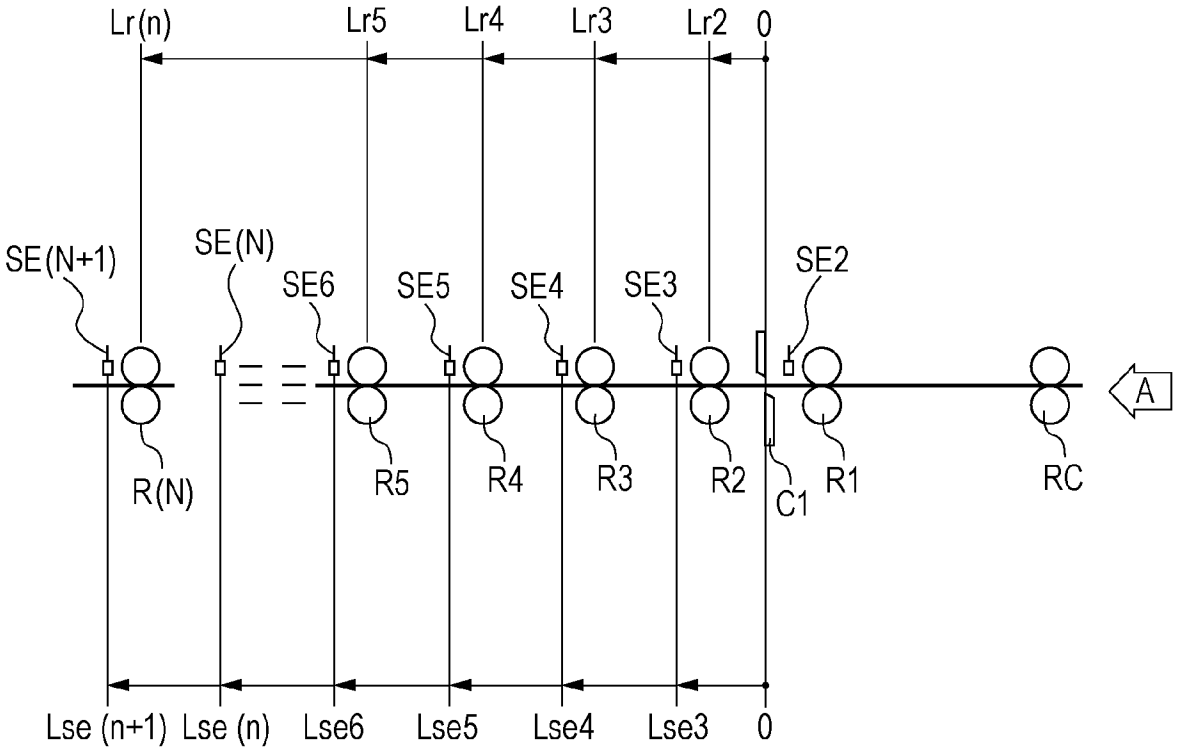
FIG. 5 is a schematic diagram illustrating the configuration of a sheet cutting and conveying mechanism of a first embodiment.

FIG. 5 is a schematic diagram illustrating the configuration of the sheet cutting and conveying mechanism of the first embodiment. In FIG. 5, the sheet is conveyed from the right to the left in FIG. 5 as indicated by arrow A. A cutter C1 that is a sheet cutting unit is a sliding-type cutter described using FIG. 4. A sheet conveying unit is a conveying roller pair constituted by a driving roller that rotates by obtaining motive power from a motor (not shown) and a driven roller that rotates freely in pressure contact with the driving roller. A sheet guide member is disposed as a supplemental conveying unit between the rollers, which is not shown in FIG. 5 because it is not necessary for describing the present invention.

A conveying roller pair RC that is the extreme upstream conveying unit feeds a continuous sheet to the cutter C1 at an upstream constant speed Vp (first conveying speed). The conveying roller pair RC does not change in speed for the cutting motion of the cutter C1 and may be included, for example, in the sheet cutting and conveying mechanism or alternatively in the checking unit that is an upstream process. A conveying roller pair R1 that is a first conveying unit is disposed upstream in the conveying direction of the cutter C1, and a conveying roller pair R2 that is a second conveying unit is disposed downstream in the conveying direction of the cutter C1. Furthermore, a roller pair R3 is disposed downstream of the conveying roller pair R2, and a conveying roller pair R4 that is a third conveying unit is disposed downstream thereof. Furthermore, roller pairs R5 to RN that are a plurality of conveying units are disposed downstream of the conveying roller pair R4 at a pitch shorter than the shortest cut length that can be achieved by the apparatus. Edge sensors SE2, SE3, SE4, SE5 to SEN that are detecting units capable of detecting the leading edge or the trailing edge of the conveyed sheet are disposed upstream of the conveying roller pairs R2, R3, R4, R5 to RN, respectively. The conveying roller pairs R(N) each have a dedicated driving source, which allows changes in speed and halting to be independently controlled. Examples of the driving sources of the conveying roller pairs R(N) include a stepping motor and a motor that employs an encoder to allow measurement of the conveying length. In the case where the cut sheet product is long, edge sensors SE(N) and conveying roller pairs R(N) are added to the downstream side. Since a control method, to be described below, uses positional information on the individual conveying roller pairs R(N) and edge sensors SE(N), FIG. 5 illustrates the positions of the individual conveying roller pairs R(N) and edge sensors SE(N) with reference to the cutting position of the cutter C1.

Figure 6:
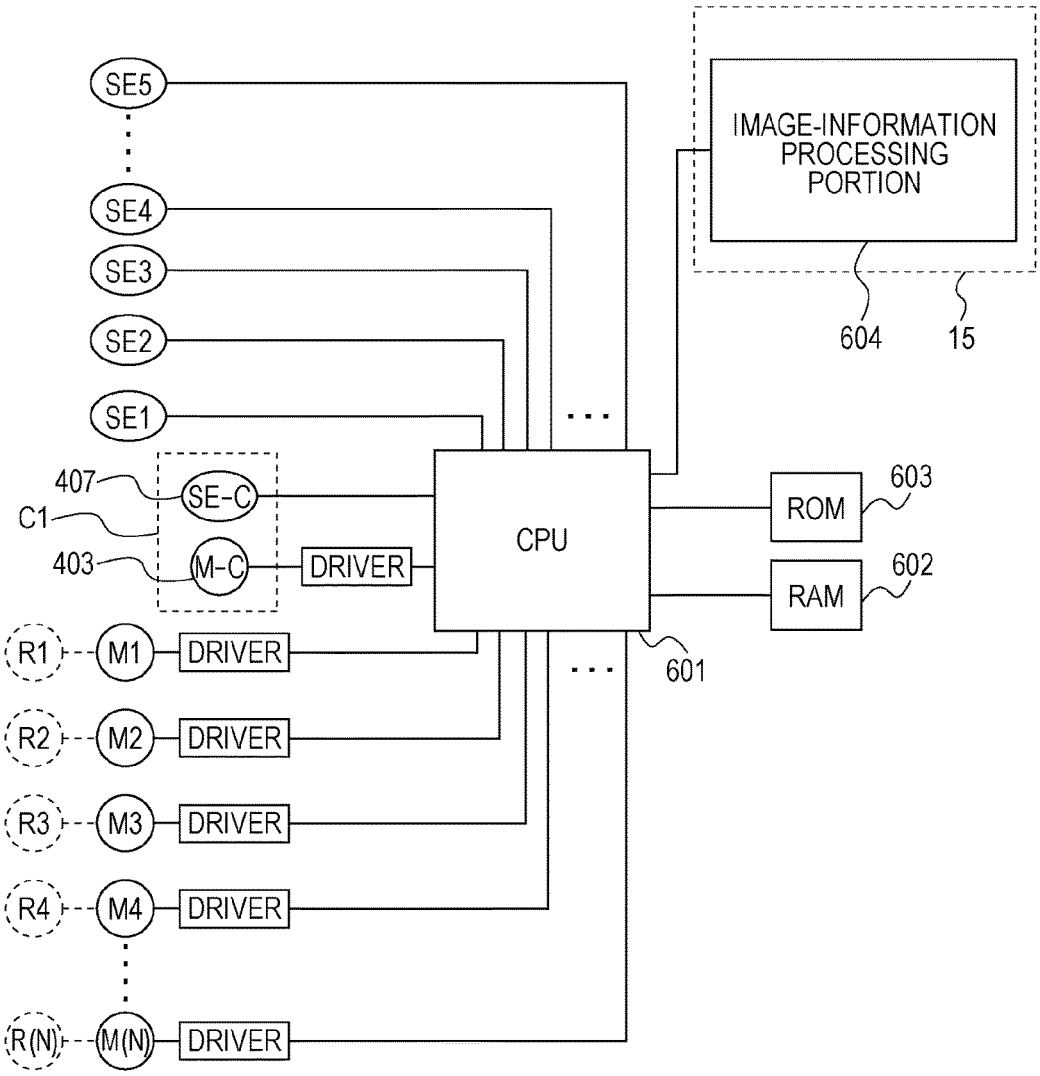
FIG. 6 is a block diagram illustrating the control configuration of the sheet cutting and conveying mechanism according to an embodiment of the present invention.

FIG. 6 is a block diagram illustrating the control configuration of the sheet cutting and conveying mechanism according to an embodiment of the present invention. The outputs of the edge sensors SE2, SE3 to SEN, etc. are input to the CPU 601. The CPU 601 controls driving of motors M1, M2, M3 to MN, etc. that are dedicated driving sources for driving the conveying roller pairs R1, R2, R3 to RN, etc., respectively, via individual drivers. The cutter motor 403 and the cutter sensor 407 included in the configuration of the cutter C1 are also connected to the CPU 601, so that the motion of the cutter C1 can be controlled. Control programs to be executed by the CPU 601 are stored in a ROM 603, and data for use in the control of the CPU 601 is stored in a RAM 602. Of the control data, data on the length of a downstream cut sheet that is a cut product and its cutting position is input from the external unit 16 to the controller 15, is processed by an image-information processing portion 604 in the controller 15, and is input to the CPU 601.

Figure 7:
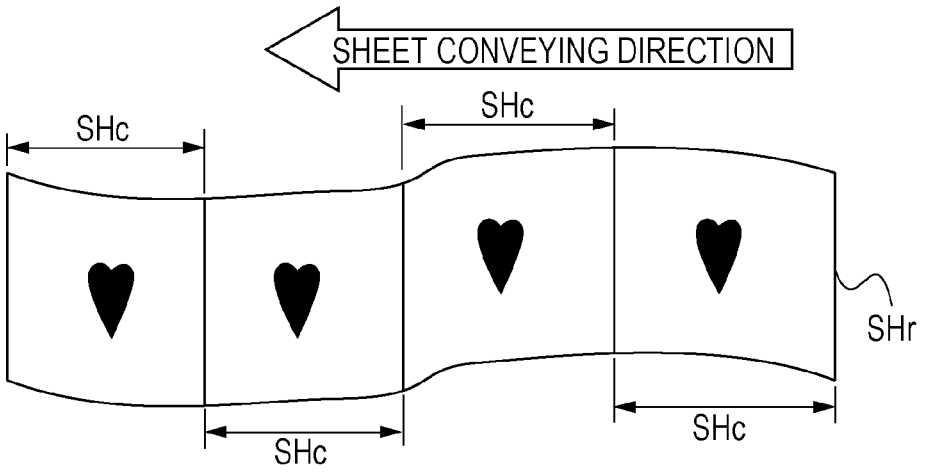
FIG. 7 illustrates an example of images formed on a yet-to-be-cut continuous sheet corresponding to the sheet cutting and conveying mechanism of the first embodiment.

FIG. 7 illustrates an example of images formed on a yet-to-be-cut continuous sheet SHr corresponding to the sheet cutting and conveying mechanism of the first embodiment. Image products SHc are continuously printed on the yet-to-be-cut continuous sheet SHr, and no waste is generated by the cutting of the cutter.

FIGS. 8A to 8E are schematic diagrams illustrating a process, in stages, in which a sheet is cut and conveyed by the sheet cutting and conveying mechanism of the first embodiment.

Figure 8A:
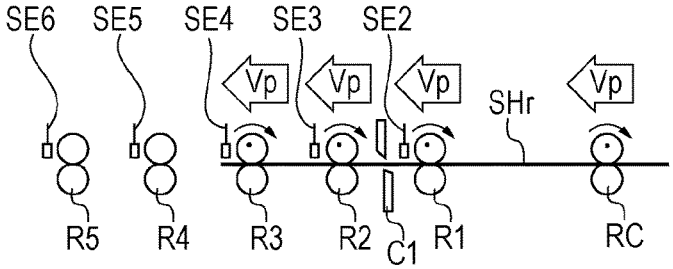
FIGS. 8A to 8E are schematic diagrams illustrating a process, in stages, in which a sheet is cut and conveyed by the sheet cutting and conveying mechanism of the first embodiment.

FIG. 8A illustrates a state until a printed sheet reaches a cutting position. The yet-to-be-cut continuous sheet SHr that is continuously conveyed from the upstream side at the conveying speed Vp that is the first conveying speed passes through the conveying roller pairs R1, R2, and R3 ahead and behind the cutter C1 that moves at the same conveying speed Vp to reach the cutting position. The cutting position can be determined, for example, by detecting the leading edge of the yet-to-be-cut continuous sheet SHr after passing through the conveying roller pair R1 by the edge sensor SE2 and determining the length, that is, the cutting position, after the sheet SHr passes between the blades of the cutter C1 at a conveying amount of the conveying roller pair R1 after the detection. The cutting position can also be determined by detecting the formed image using an image sensor not by the edge sensor SE2.

Figure 8B:
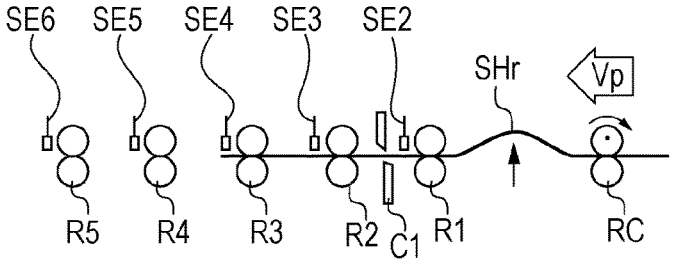

FIG. 8B illustrates a state during cutting. The conveying roller pairs R1, R2, and R3 that nip the yet-to-be-cut continuous sheet SHr halt and hold the yet-to-be-cut continuous sheet SHr during the motion of the cutter C1. Since the yet-to-be-cut continuous sheet SHr on which images are printed is conveyed from the upstream side also while the continuous sheet SHr is halted at the cutter C1, the yet-to-be-cut continuous sheet SHr slacks and is accumulated like a loop at the upstream side of the conveying roller pair R1. Although cutting time Tc during which the cutter C1 is moving varies due to such factors as the width and thickness of the sheet, the haling time Tw of the conveying roller pairs R1 to R3 is set to a constant (Tw>Tc) because the constant halting time Tw makes it easy to control the timing at which the subsequent conveying speed is changed.

Figure 8C:
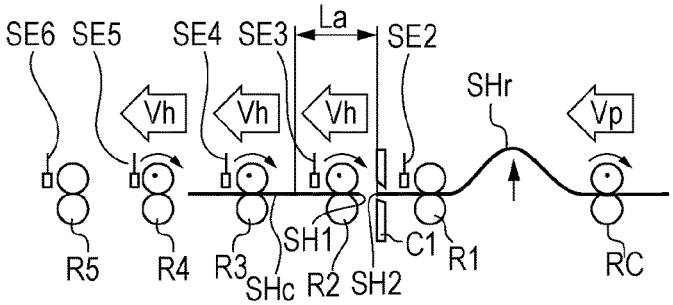

FIG. 8C illustrates a state directly after completion of the cutting, that is, after a lapse of the halting time Tw of the conveying roller pairs R1 to R3. After completion of the cutting, the image product SHc after cutting is conveyed at a third conveying speed Vh (Vh>Vp) to reduce the slack of the sheet formed during the halting and to prevent the yet-to-be-cut continuous sheet SHr and the product SHc from overlapping. After the sheet is cut, the conveying roller pairs R2, R3, and R4 are driven at the conveying speed Vh to convey the cut image product SHc by a specified distance La from the cutter C1, with the continuous-sheet-side conveying roller pair R1 halted. At that time, the cut sheet and the subsequent continuous sheet are spaced from each other. At that time, the control timing for the downstream roller pairs, to be described later, can be accurately managed by setting the length Lse3 from the cutter C1 to the edge sensor SE3 smaller than La (Lse3<La).

Figure 8D:
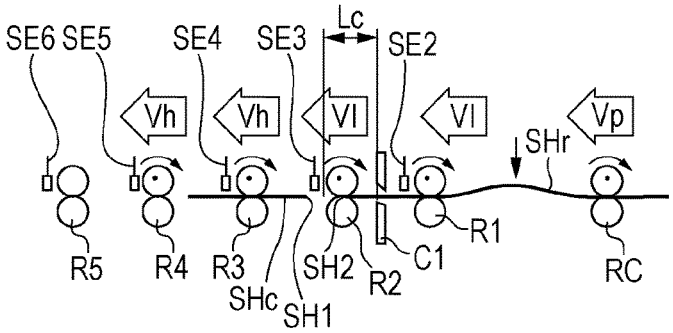

FIG. 8D illustrates a state after a minute time Td has passes directly after the product SHc is conveyed at the conveying speed Vh. The continuous sheet SHr is conveyed by a specified length Lc from the cutter C1 at the speed Vl (Vl>Vp) in cooperation of the conveying roller pairs R1 and R2 to eliminate the loop accumulated during the time (Tw+Td) during which the conveying roller pair R1 halts. The speed Vl is a second conveying speed. At that time, since the product SHc is moved prior to the leading edge of the continuous sheet SHr, setting the conveying length to La>Lc prevents overlapping.

Figure 8E:
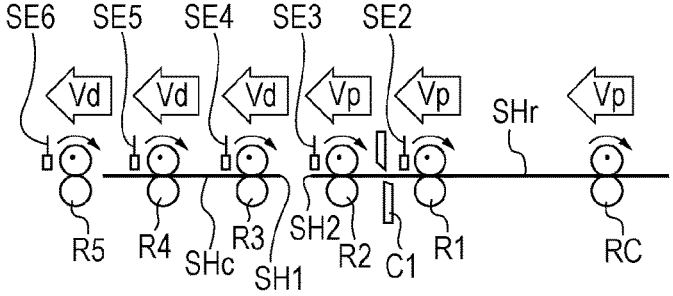

FIG. 8E illustrates a state after completion of the conveyance at the conveying speeds Vh and Vl. The product SHc is conveyed by the conveying roller pairs R3 and R4 at a forth conveying speed Vd that is used for the drying unit 8. To provide an interval between the products SHc, it is highly beneficial if Vd>Vp is satisfied. The continuous-sheet side conveying roller pairs R1 and R2 convey the continuous sheet to the next cutting position at the conveying speed Vp, the conveying speed of the conveying roller pair R3 changes from Vd to Vp, and the mechanism returns to the state in FIG. 8A and repeats the conveyance.

Figure 9:
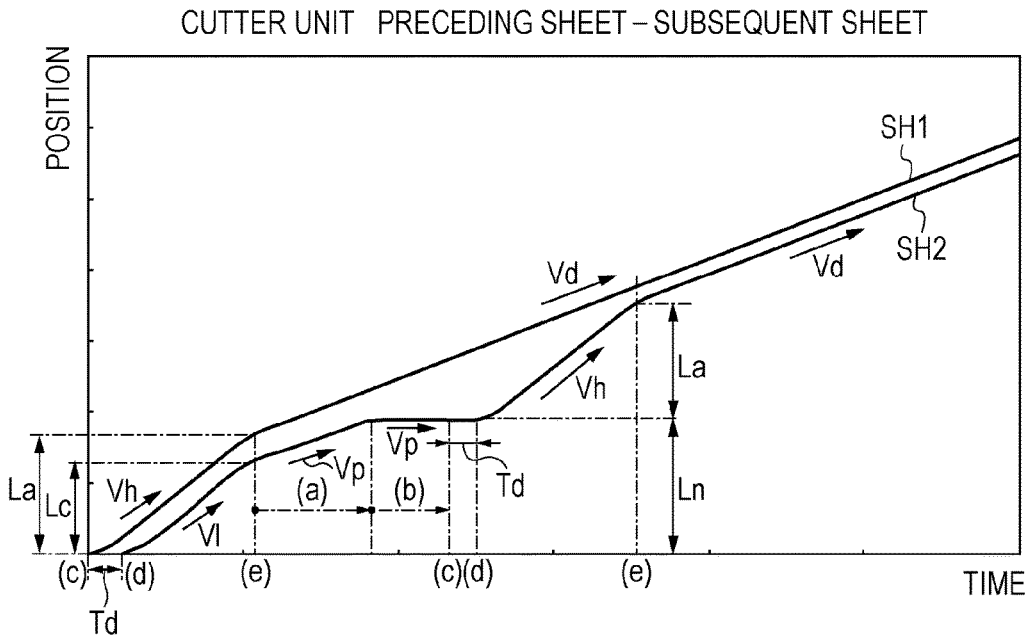
FIG. 9 is a chart illustrating a diagram when a sheet is cut and conveyed by the sheet cutting and conveying mechanism of the first embodiment.

FIG. 9 is a chart illustrating a diagram when a sheet is cut and conveyed by the sheet cutting and conveying mechanism of the first embodiment which is described using FIGS. 8A to 8E. The vertical axis indicates distance from the cutter C1, and the horizontal axis indicates time, which are marked in correspondence with the individual states shown in FIGS. 8A to 8E. The chart represents the distance between the trailing edge SH1 of the product SHc directly after cutting and the leading edge SH2 of the subsequent yet-to-be-cut continuous sheet SHr. Although the distance between the trailing edge SH1 and the leading edge SH2 is increased once because the subsequent yet-to-be-cut continuous sheet SHr is also halted for cutting, the distance becomes constant after the subsequent product SHc is completed, and the sheet is conveyed at the downstream conveying speed Vd.

By changing the sheet conveying speed as shown in FIG. 9 irrespective of the cutting length Ln of the product SHc, the sheet cutting and conveying mechanism with the configuration of the first embodiment can cut and convey the sheet without overlapping.

To cope with changes in the cutting length Ln of the product SHc, information on the product cutting length Ln is obtained in advance and individual conveying roller pairs R(N) are independently controlled while assigning speed-switching conditions thereto.

Figure 10:
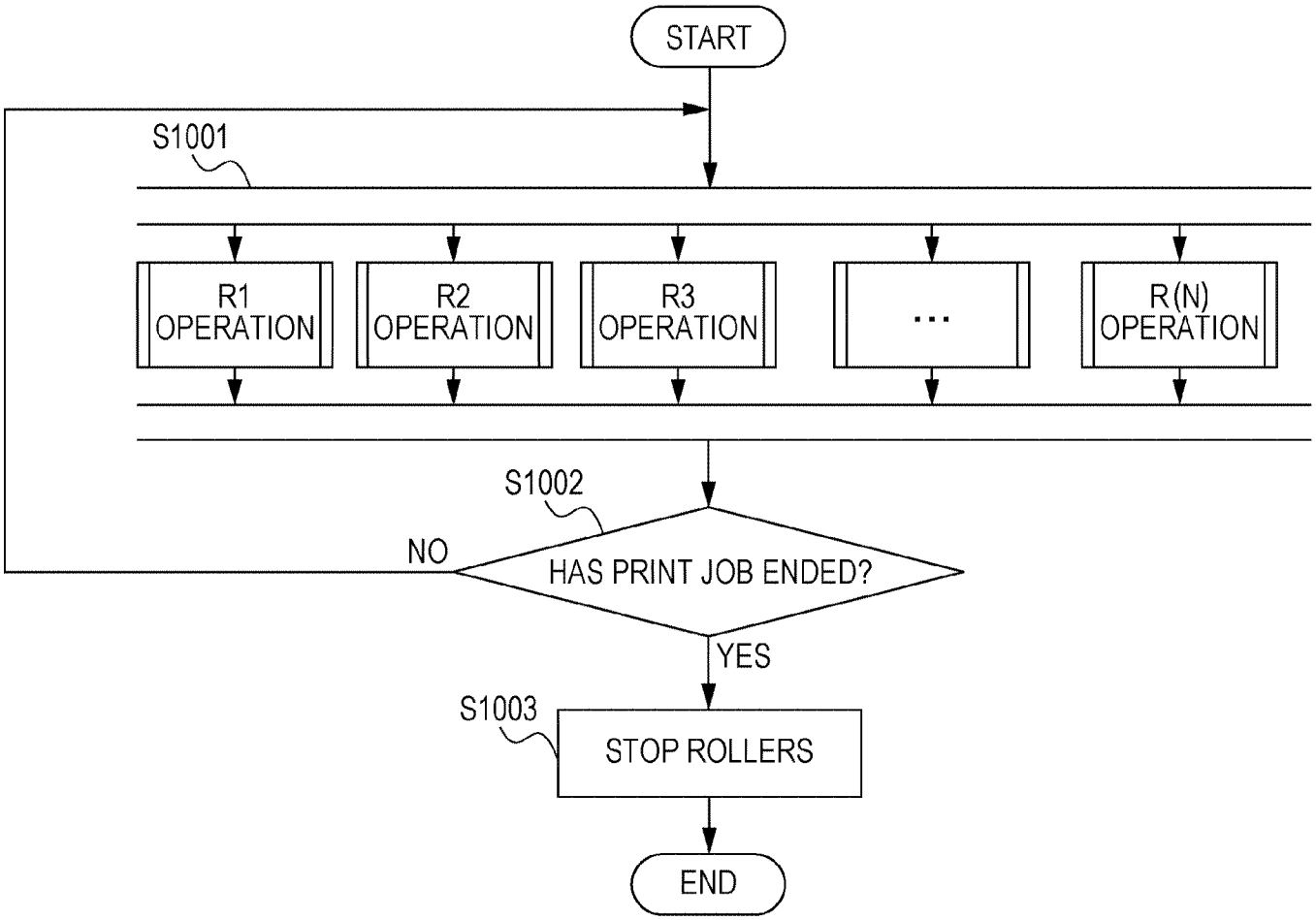
FIG. 10 is a flowchart of the operation of the sheet cutting and conveying mechanism according to an embodiment of the present invention.

FIG. 10 is a flowchart of the operation of the sheet cutting and conveying mechanism according to an embodiment of the present invention. Upon starting a printing operation, in step S1001, the individual conveying roller pairs R(N) are processed in parallel according to independent subroutines. Since the cutting motion of the cutter C1 is synchronized with the halting of the conveying roller pair R1, the cutting motion is included in the subroutine of the conveying roller pair R1.

The operation subroutines of the individual conveying roller pairs R(N) will be described.

Figure 11:
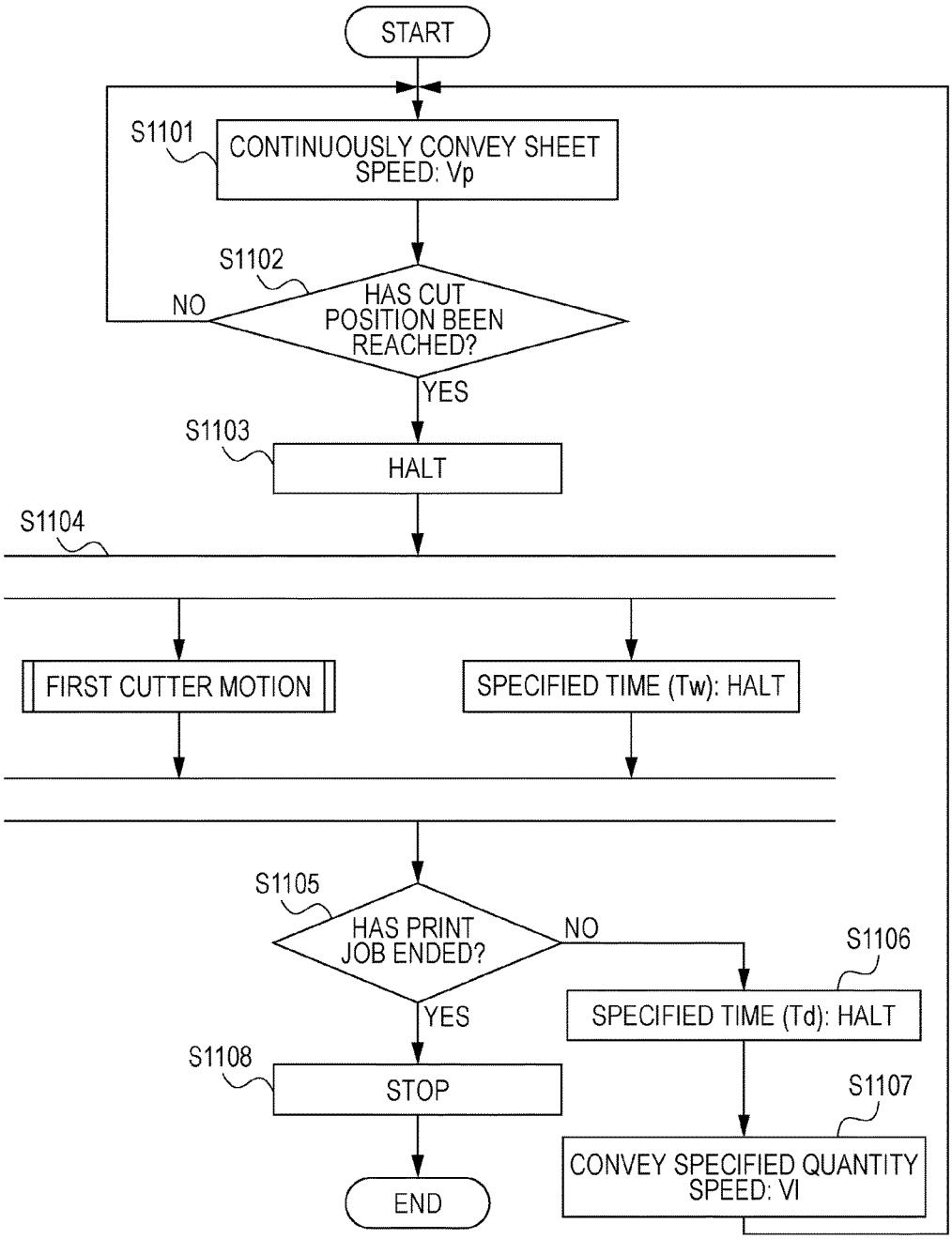
FIG. 11 is a flowchart of the operation of a conveying roller pair R1 of the sheet cutting and conveying mechanism according to the first embodiment.

FIG. 11 is a flowchart of the operation of the conveying roller pair R1 that is the first conveying unit of the sheet cutting and conveying mechanism according to the first embodiment. The conveying roller pair R1 conveys a sheet at the same conveying speed Vp as the upstream conveying speed in step S1101. When the sheet reaches a cutting position in step S1102, the conveying roller pair R1 halts for a specified time (Tw+Td) in steps S1104 and S1106 on the start of a cutting operation. Next, the conveying roller pair R1 conveys a specified quantity of sheet at the high speed Vl in step S1107 to reduce a loop formed during the halting, and repeats the above process.

Figure 12:
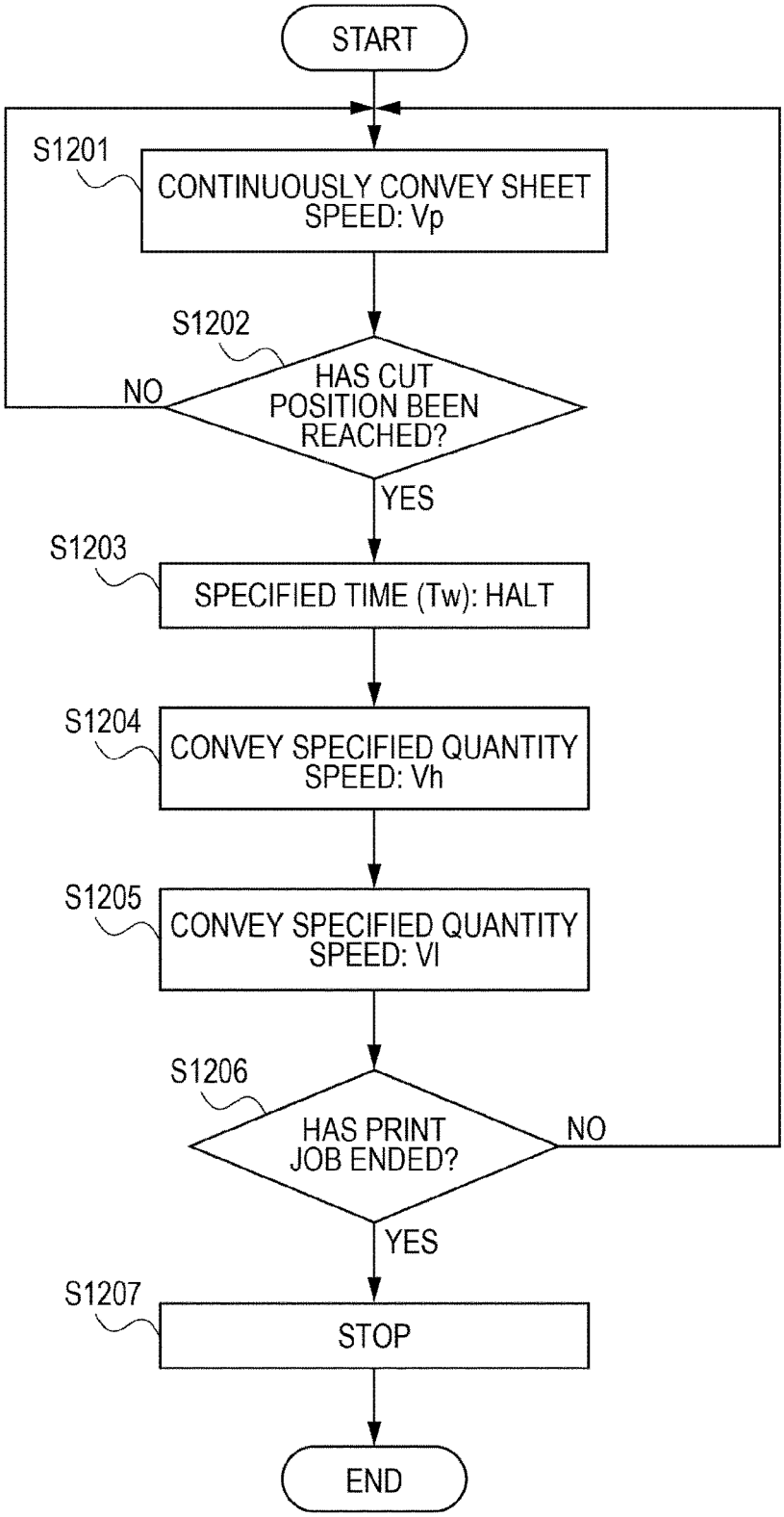
FIG. 12 is a flowchart of the operation of a conveying roller pair R2 of the sheet cutting and conveying mechanism according to the first embodiment.

FIG. 12 is a flowchart of the operation of the conveying roller pair R2 that is the second conveying unit of the sheet cutting and conveying mechanism according to the first embodiment. The conveying roller pair R2 also halts at the timing of step S1202, like the upstream conveying roller pair R1, in synchronization with the conveying roller pair R1. After halting for a specified time Tw in step S1203, the conveying roller pair R2 starts moving Td earlier than the conveying roller pair R1. In step S1204, the conveying roller pair R2 first conveys a specified feed of product SHc at the speed Vh. The feed at the speed Vh is set by adding a margin corresponding to the apparatus to the distance Lr2 from the cutter C1 to the nip of the conveying roller pair R2 to reliably convey the product SHc until the product SHc is separated from the nip of the conveying roller pair R2.

Next, in step S1205, the leading edge of the continuous sheet SHr fed from the upstream conveying roller pair R1 is conveyed at the conveying speed Vl in cooperation with the conveying roller pair R1. After the loop is eliminated by a specified feed of conveyance, the conveying roller pair R2 returns to step S1201, where the speed Vl shifts to the same conveying speed Vp as the upstream conveying speed at the same timing as the upstream conveying roller pair R1.

Setting Vl=Vh allows the step S1204 and step S1205 to be integrated.

Figure 13:
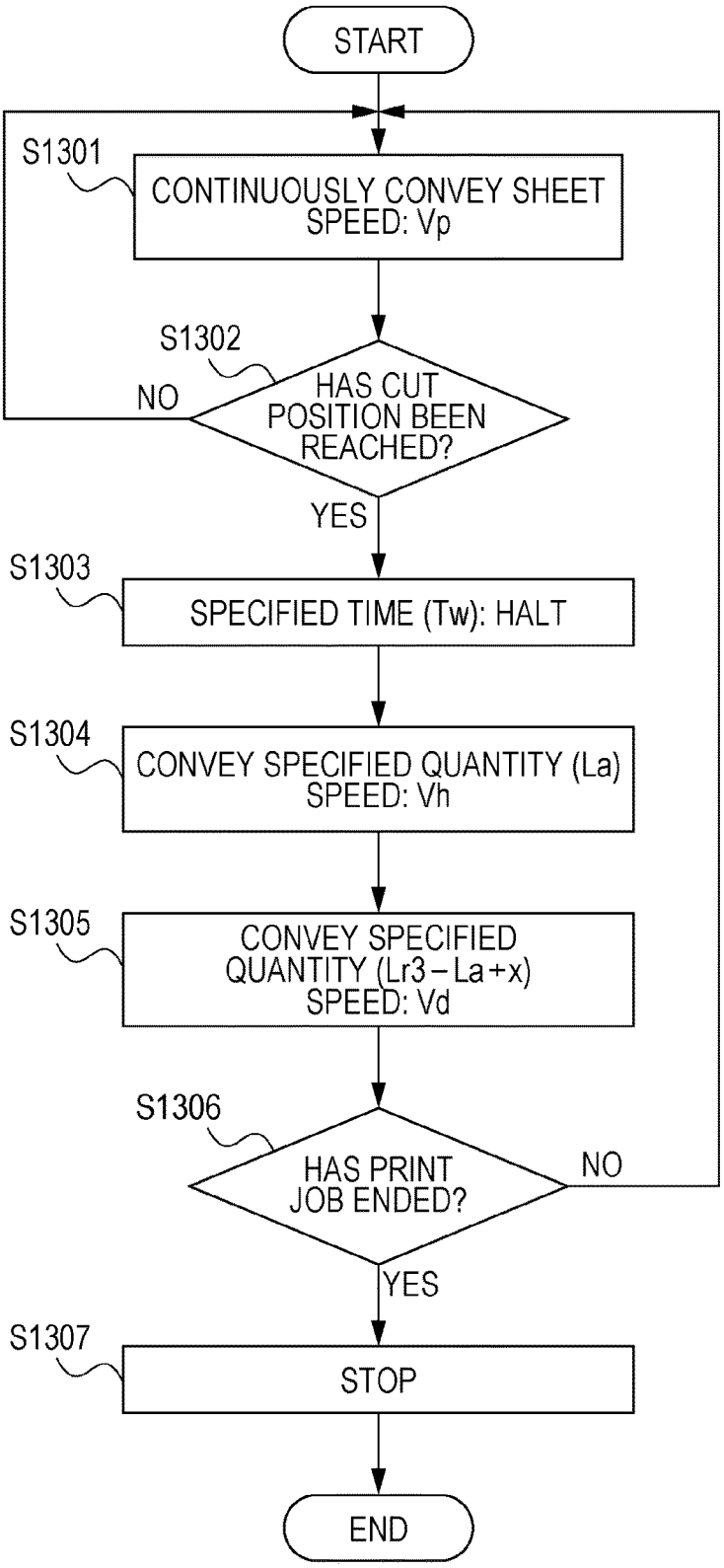
FIG. 13 is a flowchart of the operation of a conveying roller pair R3 of the sheet cutting and conveying mechanism according to the first embodiment.

FIG. 13 is a flowchart of the operation of the conveying roller pair R3 of the sheet cutting and conveying mechanism according to the first embodiment. The conveying roller pair R3 also halts at the cutting position in step S1302 in synchronization with the conveying roller pairs R1 and R2.

Since the distance Lr3 from the cutter C1 to the nip of the conveying roller pair R3 is larger than La, after the specified time Tw has passed in step S1303, the product SHc is conveyed by the specified distance La at the conveying speed Vh in step S1304. In the next step S1305, the product SHc is conveyed by a specified feed at the downstream conveying speed Vd. The feed at the speed Vd is set to (Lr3−La+x) that is obtained by subtracting the distance La from the distance Lr3 from the cutter C1 to the nip of the conveying roller pair R3 and adding a margin x corresponding to the apparatus thereto to reliably convey the product SHc until the product SHc is separated from the conveying roller pair R3.

After the conveyance, the conveying speed Vd shifts again to the same conveying speed Vp as the upstream conveying speed.

Figure 14:
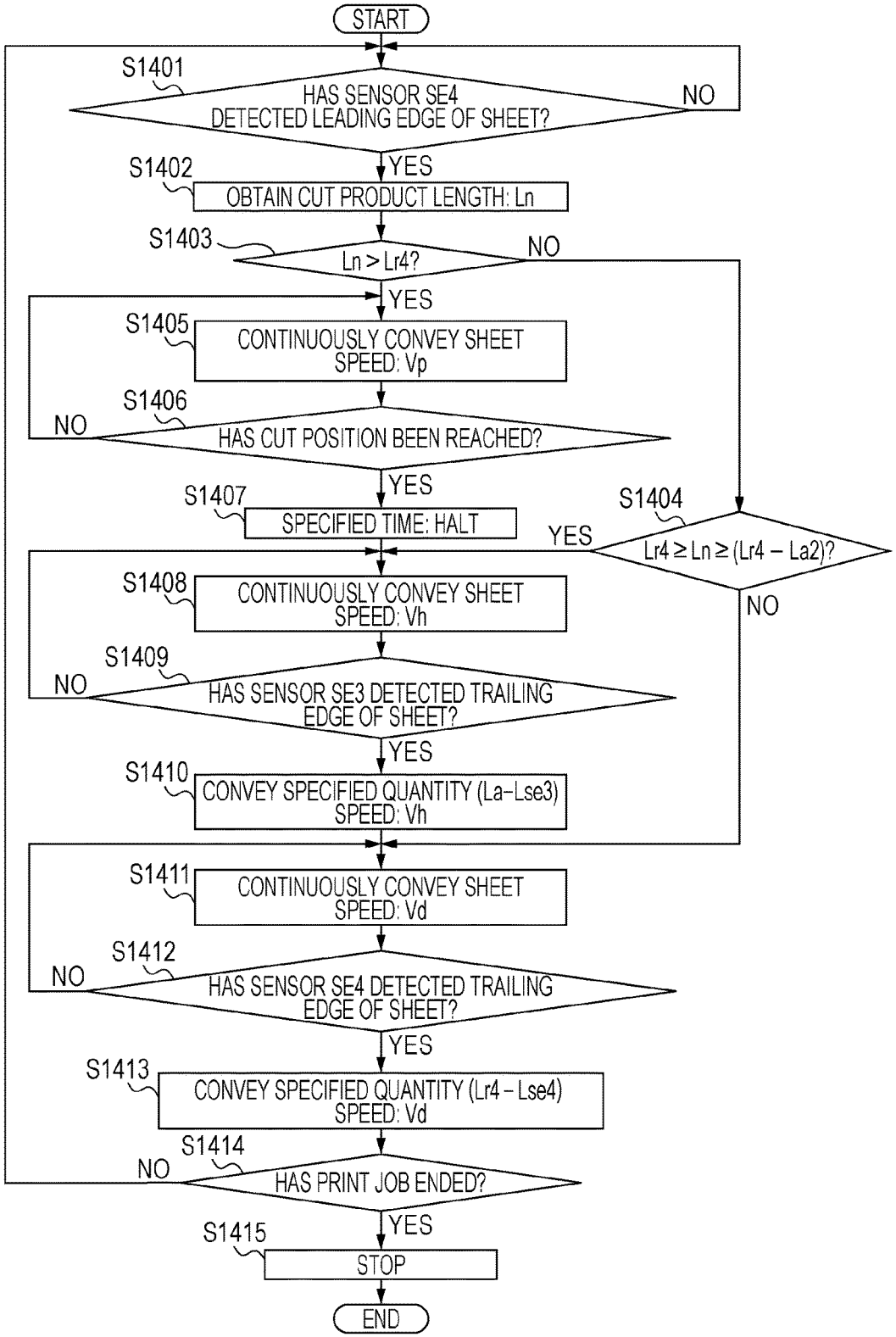
FIG. 14 is a flowchart of the operation of a conveying roller pair R4 of the sheet cutting and conveying mechanism according to the first embodiment.

FIG. 14 is a flowchart of the operation of the conveying roller pair R4 that is a third conveying unit of the sheet cutting and conveying mechanism according to the first embodiment. The conveying roller pair R4 changes in speed depending on the length Ln of the cut product SHc. First, in step S1401, the leading edge of a sheet conveyed next is detected by an edge sensor SE4 that is disposed upstream of the conveying roller pair R4. The length Ln of the cut product SHc is obtained at the detection timing, and the length Ln is compared with a constant to determine the conveying speed.

In step S1403, it is determined whether the conveying roller pair R4 nips the sheet during cutting. If the length Ln is larger than the distance Lr4 from the cutter C1 to the nip of the conveying roller pair R4 in step S1403, the conveying roller pair R4 moves to step S1405 and is driven at the upstream conveying speed Vp to convey the yet-to-be-cut continuous sheet SHr. If the sheet is conveyed to the cutting position in step S1406, the conveying roller pair R4 halts for the specified time Tw in step S1407. At that time, the sheet is cut, while the conveying roller pair R4 nips the sheet during the cutting of the sheet. Upon completion of the cutting after a lapse of time Tw, the conveying roller pair R4 moves to step S1408, in which the sheet is conveyed at the high running speed Vh.

If the length Ln is smaller than (Lr4−La), the conveying roller pair R4 moves to step S1404 and then to step S1411 to convey the cut product SHc at the downstream conveying speed Vd that is a fourth conveying speed.

If the length Ln lies therebetween (Lr4≥Ln≥(Lr4−La), the conveying roller pair R4 conveys the cut product SHc at the high running speed Vh in step S1408. The cut product SHc is conveyed by (La−Lse3) at the conveying speed Vh in step S1410 after the timing at which the edge sensor SE3 has detected the trailing edge SH1 of the cut product SHc in step S1409, and then the conveying speed Vh shifts to the downstream constant speed Vd in step S1411. At that time, the leading-edge detection timing of the sensor SE4 is set to always precede the trailing-edge detection timing of the sensor SE3. This requires the condition that the feed at the speed Vh after the trailing edge has passed through the edge sensor SE3 is smaller than the distance between the conveying roller pair R4 and the edge sensor SE, that is, (La−Lse3)<(Lr4−Lse4).

Figure 15:
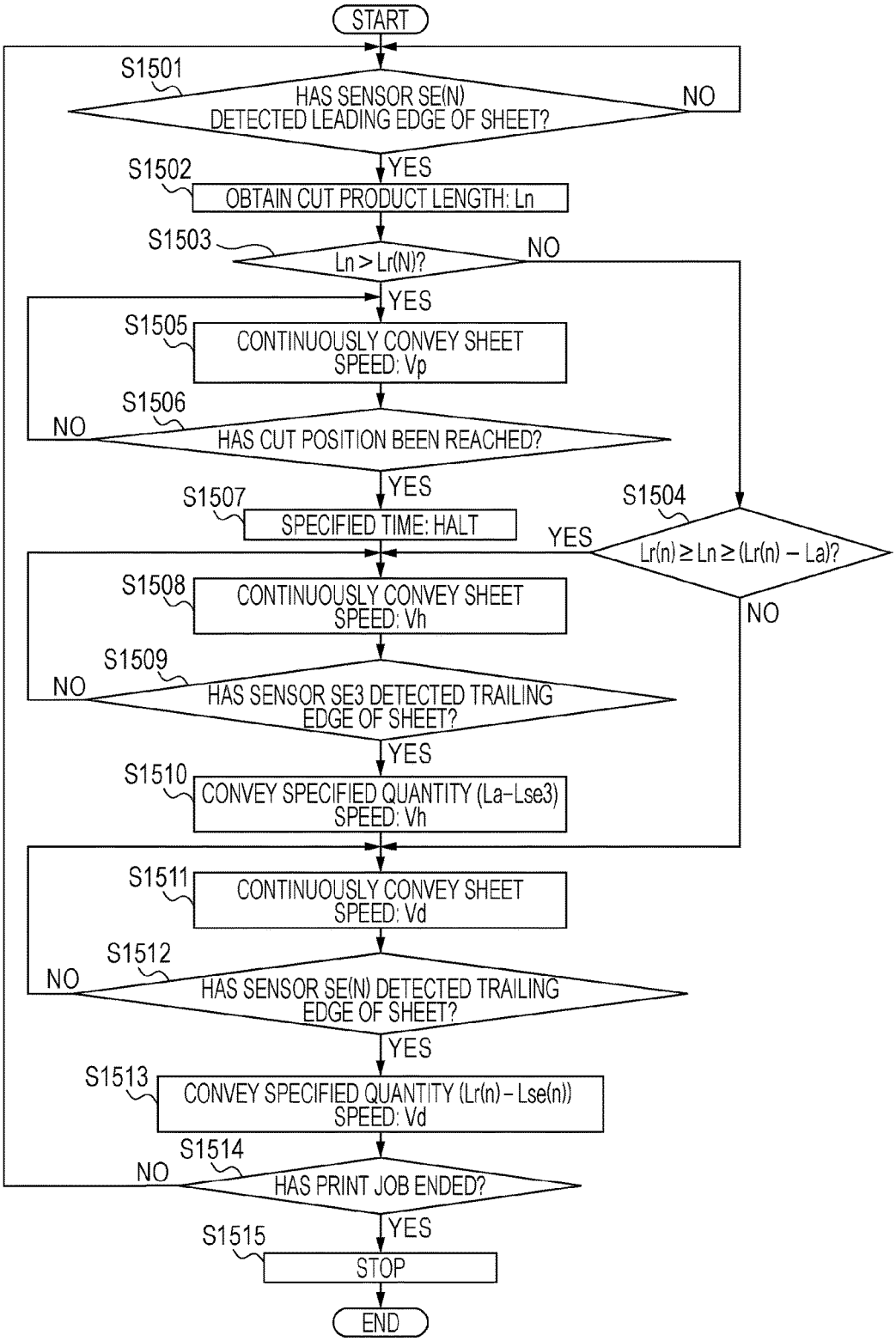
FIG. 15 is a flowchart of the operation of Nth conveying roller pair R(N) following the fourth conveying roller pair of the sheet cutting and conveying mechanism according to the first embodiment.

FIG. 15 is a flowchart of the operation of the conveying roller pairs R(N) of the sheet cutting and conveying mechanism according to the first embodiment. If the length Ln of the cut product SHc is large, edge sensors SE(N) and conveying roller pairs R(N) are added to the downstream side. When edge sensors SE(N) and conveying roller pairs R(N) are disposed at a constant pitch, and a condition, (La−Lse3)<(Lr(n)−Lse(n)), is satisfied, a sequence similar to that in FIG. 14 can be applied only by changing steps S1501, S1503, S1504, and S1513.

In a printer that forms images on a continuous sheet using an inkjet recording unit, and after forming the images, that cuts the continuous sheet into simple image products, and that conveys the cut image products to a drying process, this embodiment offers the advantages of enhancing the speed, reducing the size, and coping with a sheet cutting length.

Second Embodiment

In a second embodiment, an example in which two cutting units are used will be described.

Figure 16:
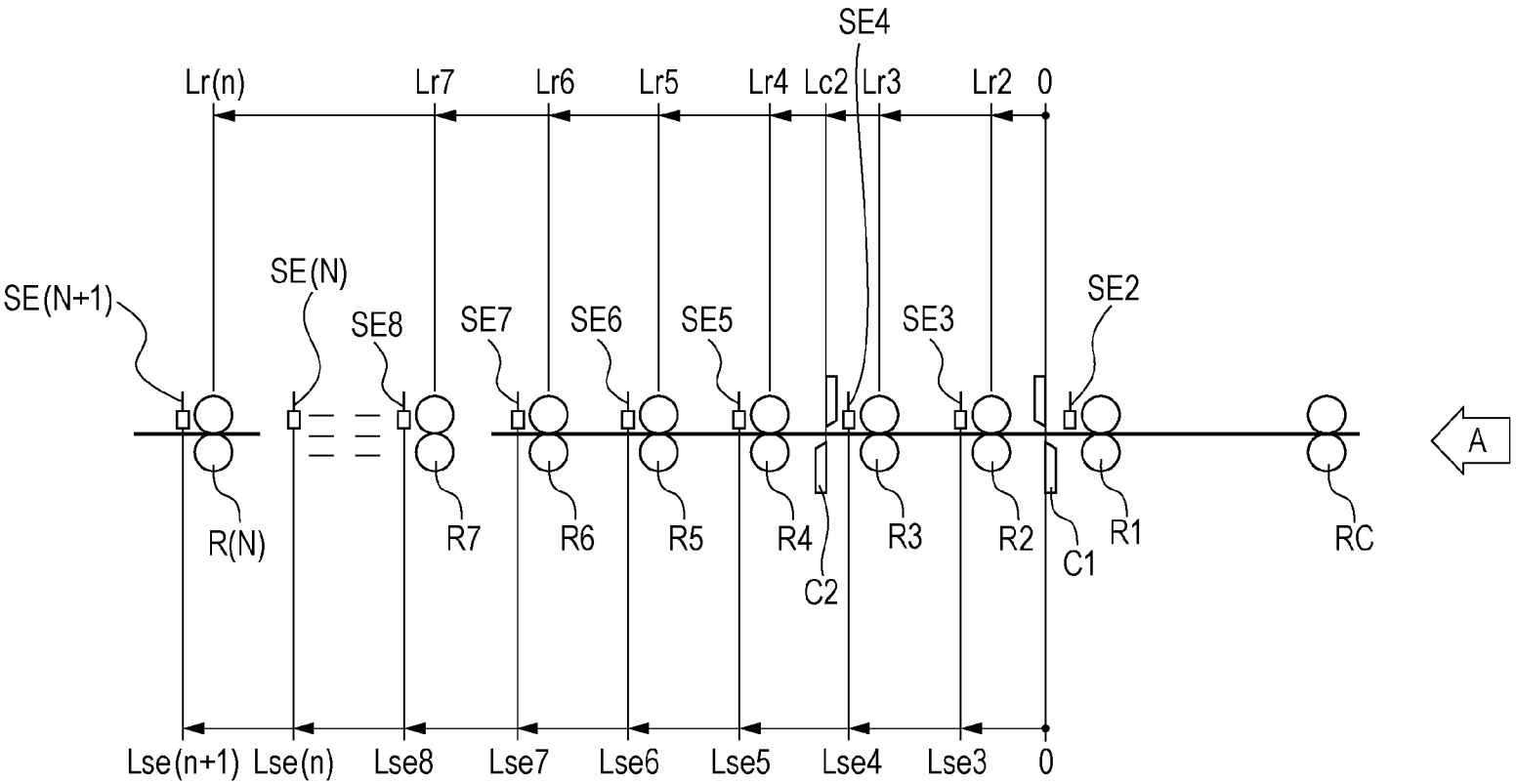
FIG. 16 is a schematic diagram illustrating the configuration of a sheet cutting and conveying mechanism according to a second embodiment.

FIG. 16 is a schematic diagram illustrating the configuration of a sheet cutting and conveying mechanism of the second embodiment. In FIG. 16, the sheet is conveyed from the right to the left in FIG. 6 as indicated by arrow A. The cutting unit includes two sets of sliding-type cutters constituted by a pair of fixed blade and movable blade, as in the first embodiment, that is, a first cutter C1 and a second cutter C2 that is a second cutting unit. A sheet conveying unit includes conveying roller pairs that can be independently driven, as in the first embodiment, and the functions, such as a driving source, are also the same as in the first embodiment. A sheet guide member is disposed as a supplemental conveying unit between the rollers, which is not shown also in FIG. 16 because it is not necessary for describing the present invention.

A conveying roller pair RC that is the extreme upstream conveying unit feeds a continuous sheet to the first cutter C1 at a constant speed Vp that is a first conveying speed and does not change the speed for the cutting motion of the first cutter C1. The conveying roller pair RC is not necessarily be included in the sheet cutting and conveying mechanism but may be included in the checking unit that is an upstream process. A conveying roller pair R1 that is a first conveying unit is disposed upstream of the first cutter C1; conveying roller pairs R2 and R3 are disposed between the first cutter C1 and the second cutter C2; and conveying roller pairs R4, R5, R6, and R7 are disposed downstream of the second cutter C2. Edge sensors SE2, SE3, SE4, SE5, SE6, and SE7 that can detect the leading edge or the trailing edge of the conveyed sheet are disposed upstream of the conveying roller pairs R2, R3, R4, R5, R6, and R7, respectively. If the length of the cut product SHc is large, edge sensors SE(N) and conveying roller pairs R(N are added to the downstream side. Since a control method, to be described below, uses positional information on the individual conveying roller pairs R(N) and edge sensors SE(N), FIG. 16 illustrates the positions of the individual conveying roller pairs R(N) and edge sensors SE(N) with reference to the cutting position of the first cutter C1.

Figure 17:
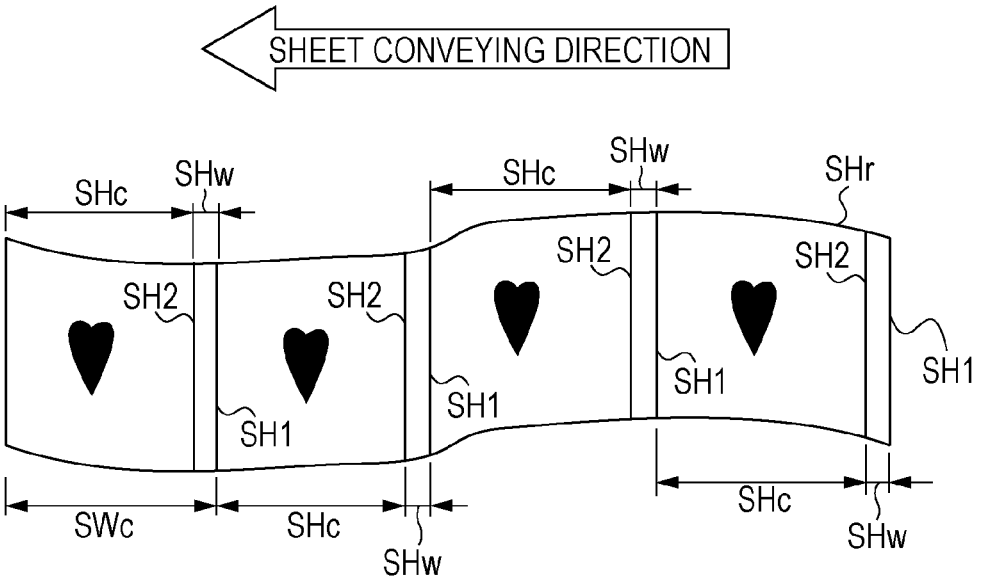
FIG. 17 illustrates an example of images formed on a yet-to-be-cut continuous sheet corresponding to the sheet cutting and conveying mechanism of the second embodiment.

FIG. 17 illustrates an example of images formed on a yet-to-be-cut continuous sheet SHr corresponding to the sheet cutting and conveying mechanism of the second embodiment. Images are printed on the yet-to-be-cut continuous sheet SHr in such a manner that image products SHc that are cut into prints and nonproducts SHw to be discarded continue alternately. The first cutter C1 and the second cutter C2 separate prints and wastes from each other. The nonproducts SHw to be discarded are used to obtain the cut products SHc and are also used for marking for accurate detection of cutting positions, for overprinting for obtaining marginless image products, for maintaining print heads, etc. A position at which the sheet is cut by the first cutter C1 is a boundary SH1 at the leading edge of the second image from the leading edge of the sheet. A semiproduct SWc having an image at the leading edge and the subsequent nonproduct SHw is formed by cutting. The downstream portion of the sheet cut by the first cutter C1 is conveyed, with the nonproduct SHw left at the upstream side, and is then cut by the second cutter C2. A position at which the sheet is cut by the second cutter C2 is a boundary SH2 at the trailing edge of the image, at which the nonproduct SHw is cut off from the image portion to form a product.

FIGS. 18A to 18D and 19A to 19D are schematic diagrams illustrating a process in which a sheet is cut and conveyed by the sheet cutting and conveying mechanism of the second embodiment.

Figure 18A:
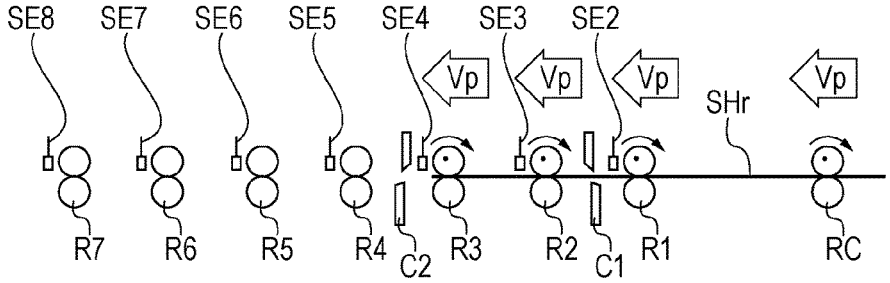
FIGS. 18A to 18D are schematic diagrams illustrating the operation of the sheet cutting and conveying mechanism of the second embodiment.

FIG. 18A illustrates a state until a printed sheet reaches a cutting position, which is the same as in first embodiment. The yet-to-be-cut continuous sheet SHr that is continuously conveyed from the upstream side at the conveying speed Vp passes through the conveying roller pairs R1, R2, and R3 ahead and behind the first cutter C1 cutting that moves at the same conveying speed Vp to reach the cutting position. The cutting position can be determined, for example, by detecting the leading edge of the yet-to-be-cut continuous sheet SHr after passing through the conveying roller pair R1 by the edge sensor SE2 and determining the length, that is, the cutting position, after the sheet SHr passes between the blades of the cutter C1 at the conveying amount of the conveying roller pair R1 after the detection. The cutting position can be determined also by detecting the formed image using an image sensor not by the edge sensor SE2.

Figure 18B:
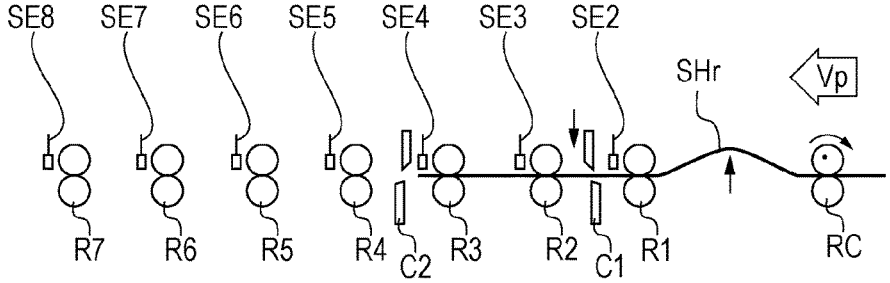

FIG. 18B illustrates a state in which the yet-to-be-cut continuous sheet SHr is cut by the first cutter C1, which is the same operation as in the first embodiment. The conveying roller pairs R1, R2, and R3 that nip the continuous sheet SHr halt and hold the continuous sheet SHr during the motion of the first cutter C1. Since the continuous sheet SHr on which images are printed is conveyed from the upstream side also while the continuous sheet SHr is halted at the first cutter C1, the continuous sheet SHr slacks and is accumulated like a loop at the upstream side of the conveying roller pair R1. Although cutting time Tc during which the first cutter C1 is moving varies due to such factors as the width and thickness of the sheet, the haling time Tw of the conveying roller pairs R1 to R3 is set to a constant (Tw>Tc) because the constant halting time Tw makes it easy to control the timing at which the subsequent conveying speed is changed.

Figure 18C:
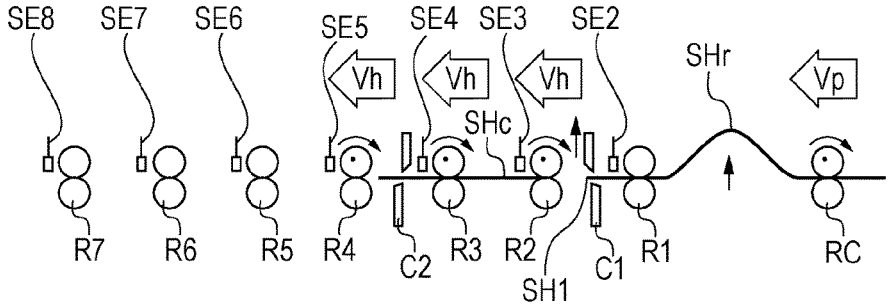

FIG. 18C illustrates a state directly after completion of the cutting of the first cutter C1. After completion of the cutting, the cut product SHc that is a downstream side sheet is conveyed at the third conveying speed Vh higher than the continuous-sheet conveying speed Vp to prevent the yet-to-be-cut continuous sheet SHr and the product SHc from overlapping. The conveying roller pairs R2, R3, and R4 are driven at the conveying speed Vh to convey the semiproduct SWc including the nonproduct SHw to be discarded after cutting to the cutting position of the second cutter C2 while the conveying roller pair R1 at the continuous sheet side halted.

Figure 18D:
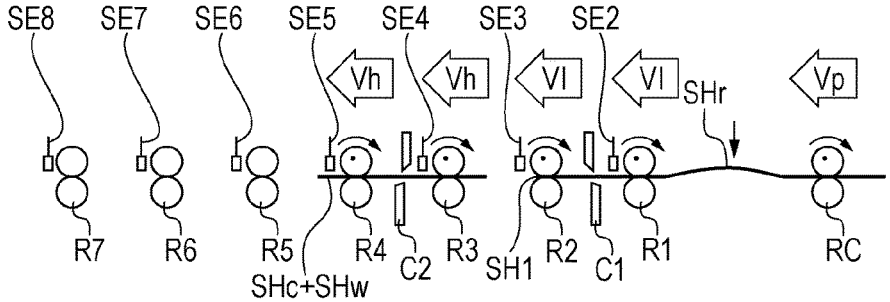

FIG. 18D illustrates a state after a minute time Td has passed directly after the semiproduct SWc including the nonproduct SHw is conveyed at the speed Vh. The continuous sheet SHr is conveyed by a specified length Lc from the first cutter C1 at the second conveying speed Vl (Vl>Vp) in cooperation of the conveying roller pairs R1 and R2 to eliminate the loop accumulated during the time (Tw+Td) during which the conveying roller pair R1 halts. At that time, a condition is set for preventing the semiproduct SWc and the leading edge of the continuous sheet SHr from overlapping.

Figure 19A:
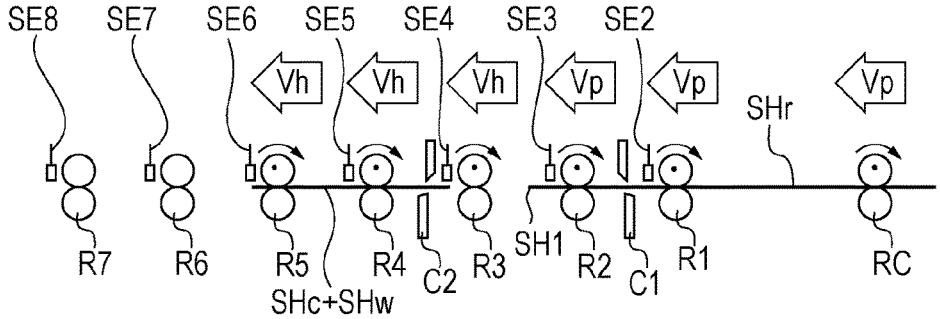
FIGS. 19A to 19D are schematic diagrams illustrating the operation of the sheet cutting and conveying mechanism of the second embodiment.

FIG. 19A illustrates a state in which the semiproduct SWc including the nonproduct SHw, cut by the first cutter C1, has reached the cutting position of the second cutter C2. The cutting position can be determined by detecting the leading edge of the continuous sheet SHr that is cut by the first cutter C1 and is conveyed at the conveying speed Vh with the edge sensor SE4 and determining the length, that is, the cutting position, after the continuous sheet SHr passes between the blades of the second cutter C2 at the rotational speed of the conveying roller pair R4 after the detection. The cutting position can be determined by detecting the formed image using an image sensor not by the edge sensor SE4, as in the first cutter C1.

Figure 19B:
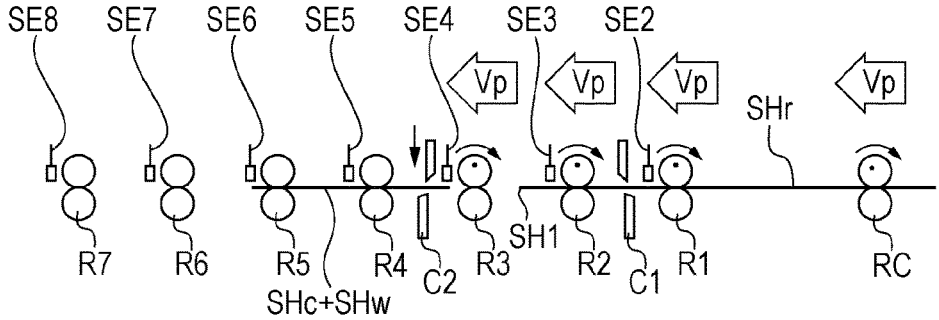

FIG. 19B illustrates the cutting of the second cutter C2. The semiproduct SWc including the nonproduct SHw, cut by the first cutter C1, is nipped and halted by the conveying roller pairs R4 and R5 downstream of the second cutter C2. The roller pairs R4 and R5 halt during the motion of the second cutter C2. The nonproduct SHw upstream of the second cutter C2 is cut off and may be discharged from the sheet conveying path by free fall or the like.

Figure 19C:
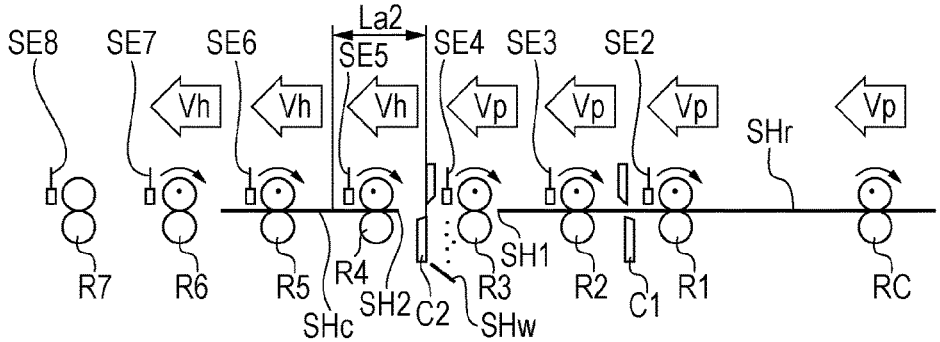

FIG. 19C illustrates a state directly after completion of the cutting of the second cutter C2. The product SHc produced by the cutting of the second cutter C2 is conveyed from the upstream side at the high running speed Vh. To prevent the product SHc from overlapping with a new semiproduct SWc after completion of cutting of the first cutter C1, the product SHc is conveyed by a specified distance La2 by the conveying roller pairs R4, R5, and R6 at the speed Vh higher than the continuous-sheet conveying speed Vp. At that time, the control timing for the downstream roller pairs, described hereinbelow, can be accurately managed by setting the length (Lse5−Lc2) from the second cutter C2 to the edge sensor SE5 smaller than La2 ((Lse5−Lc2)<La2).

Figure 19D:
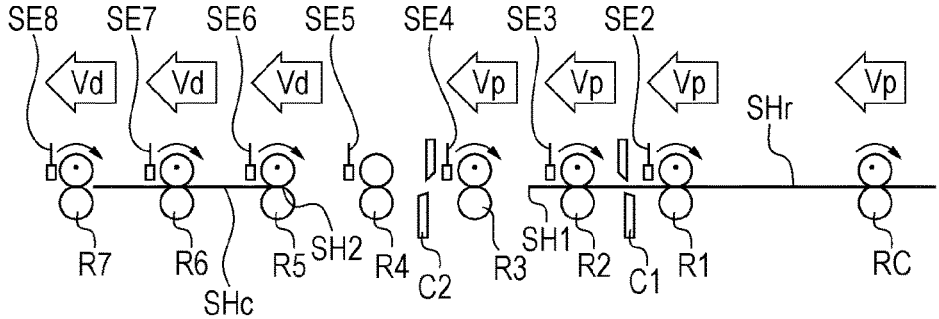

FIG. 19D illustrates a state subsequent to FIG. 19C. The product SHc is conveyed by the conveying roller pairs R5 and R6 at the speed Vd that is used for the drying unit 8. The conveying roller pair R4 from which the product SHc is separated returns to the state in FIG. 19A and repeats the conveyance. At that time, to provide an interval between the products SHc, Vd>Vp or Vd=Vp should be satisfied.

Figure 20:
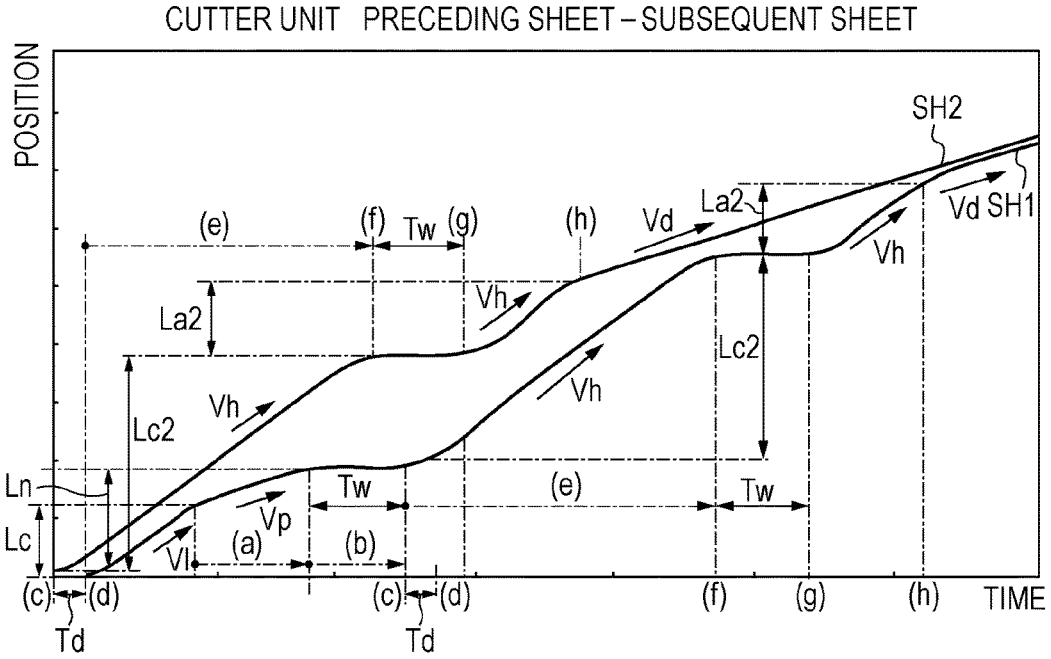
FIG. 20 is a chart illustrating a diagram when a sheet is cut and conveyed by the sheet cutting and conveying mechanism of the second embodiment.

FIG. 20 is a chart illustrating a diagram when a sheet is cut and conveyed by the sheet cutting and conveying mechanism of the second embodiment. The vertical axis indicates distances from the first cutter C1, and the horizontal axis indicates time. The chart represents the distance between the trailing edge SH2 of the product SHc directly after the sheet is cut and the leading edge SH1 of the subsequent continuous sheet SHr. Although the distance between the trailing edge SH2 and the leading edge SH1 is increased once because the subsequent continuous sheet SHr is also halted for cutting, the distance becomes constant after the trailing edge SH2 of the subsequent sheet SHr is cut, and the sheet is conveyed at the downstream conveying speed Vd.

By changing the sheet conveying speed as shown in FIG. 20 irrespective of the cutting length Ln of the product SHc, the sheet cutting and conveying mechanism with the configuration of the second embodiment can cut and convey the sheet without overlapping, as in the first embodiment. To cope with changes in the cutting length Ln of the products SHc, information on the product cutting length Ln is obtained in advance and the individual conveying roller pairs R(N) are independently controlled while assigning speed-switching conditions thereto, as in the first embodiment.

Flowcharts for the operation of the sheet cutting and conveying mechanism according to the second embodiment will be described hereinbelow. A flowchart of the entire mechanism is the same as that of the first embodiment in FIG. 10, in which, upon starting a printing operation, the individual conveying roller pairs R(N) are processed in parallel according to independent subroutines. Since the cutting motions of the first and second cutters C1 and C2 are synchronized with the halting of the conveying roller pair R1, the cutting motion of the first cutter C1 is included in the subroutine of the conveying roller pair R1, and the cutting motion of the second cutter C2 is included in the subroutine of the conveying roller pair R4.

Since the subroutines of the conveying roller pair R1 that is the first conveying unit and the conveying roller pair R2 that is the second conveying unit are omitted because they are the same as in the first embodiment, the subroutine of the operation of the conveying roller pair R3 will now be described.

Figure 21:
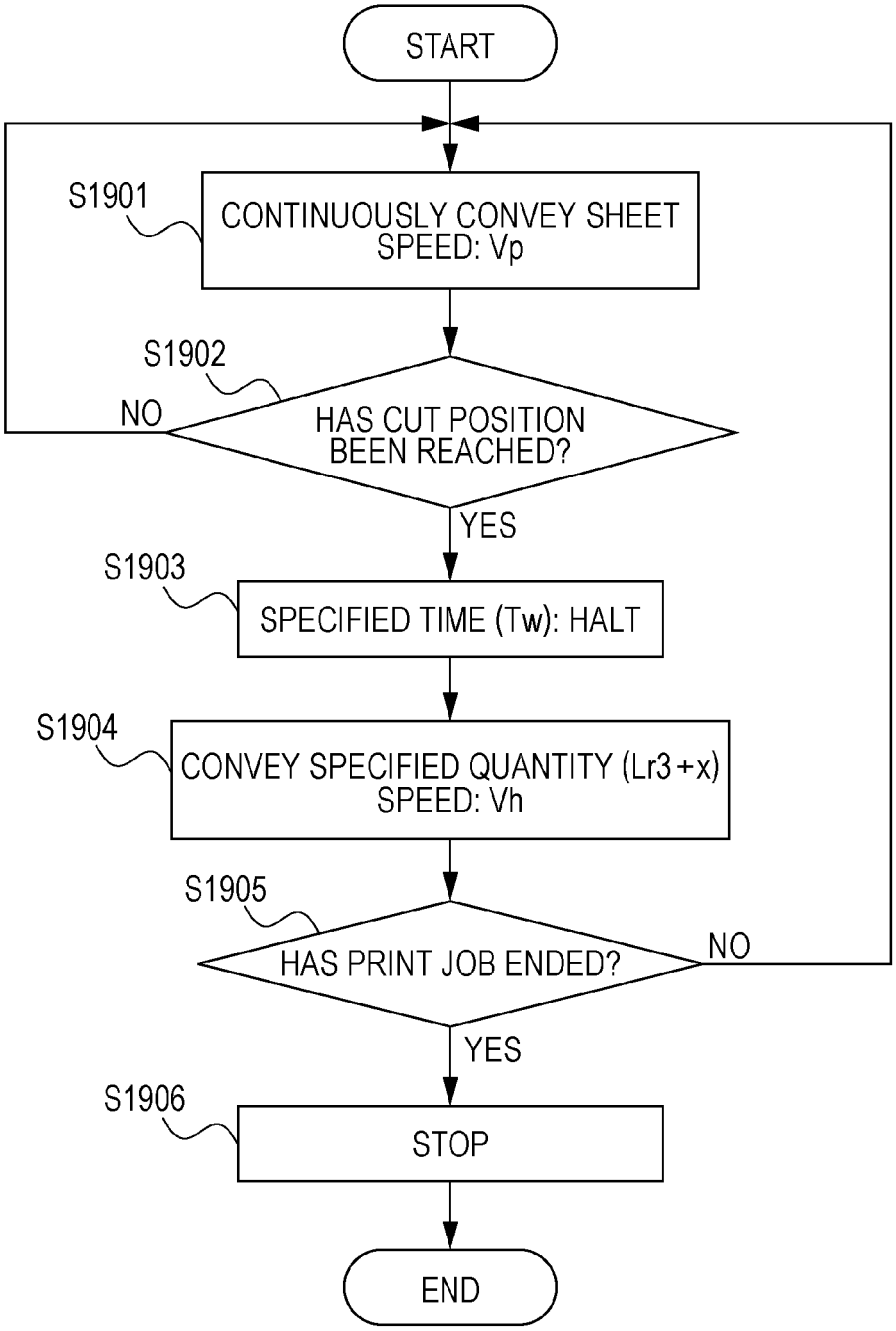
FIG. 21 is a flowchart of the operation of a conveying roller pair R3 of the sheet cutting and conveying mechanism according to the second embodiment.

FIG. 21 is a flowchart of the operation of the conveying roller pair R3 of the sheet cutting and conveying mechanism according to the second embodiment. The conveying roller pair R3 also halts in step S1902 at the cutting-position halt timing, like the upstream conveying roller pairs R1 and R2, in synchronization therewith. After halting for a specified time Tw in step S1903, the conveying roller pair R2 conveys a specified feed of product SHc at the speed Vh in step S1904 and returns to step S1901. The feed at the speed Vh is set to (Lr3+x) obtained by adding a margin x corresponding to the apparatus to the distance Lr3 from the first cutter C1 to the nip of the conveying roller pair R3 to reliably convey the cut product SHc until the product SHc is separated from the nip of the conveying roller pair R3.

Figure 22:
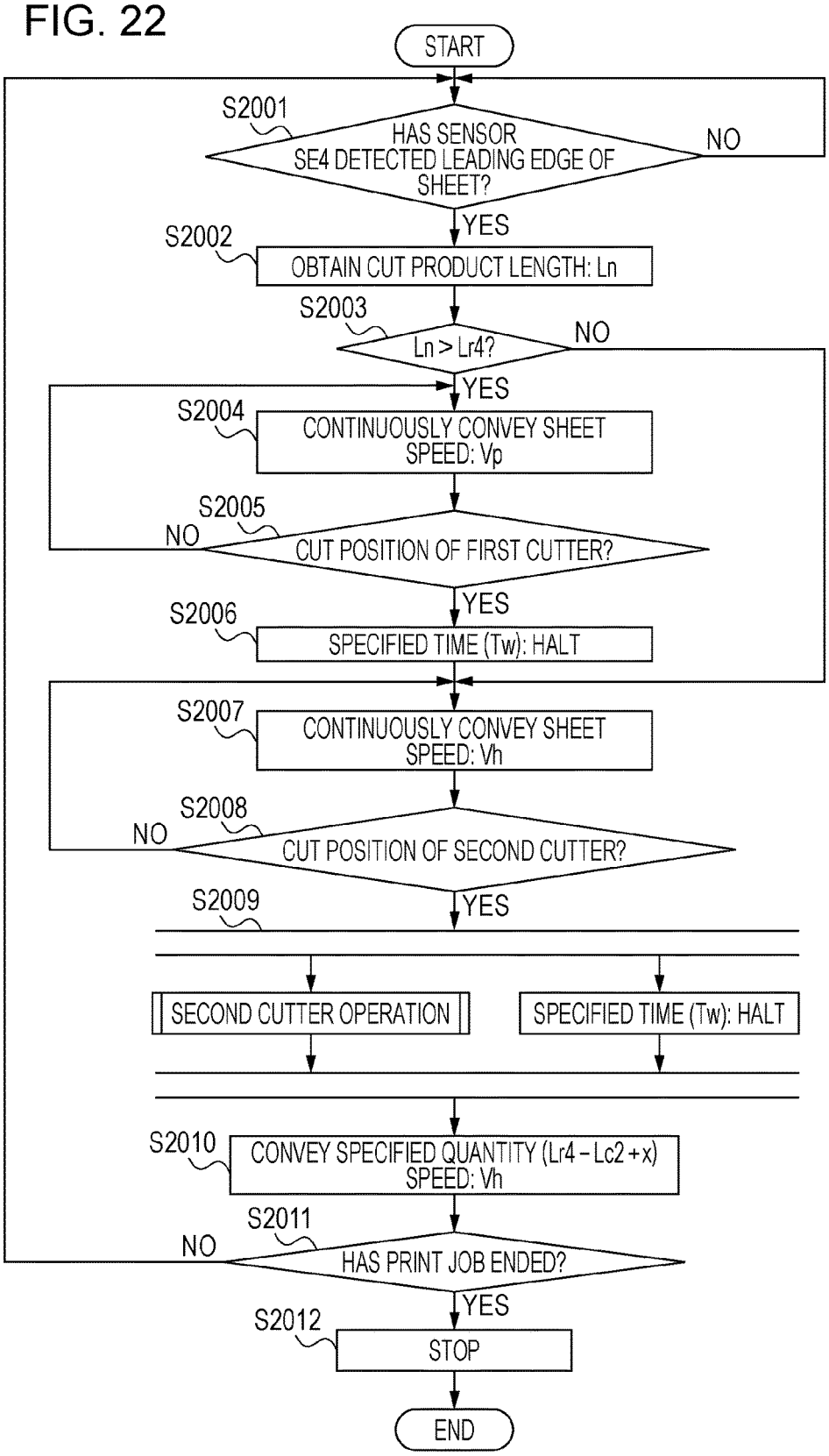
FIG. 22 is a flowchart of the operation of a conveying roller pair R4 of the sheet cutting and conveying mechanism according to the second embodiment.

FIG. 22 is a flowchart of the operation of the conveying roller pair R4 that is a third conveying unit of the sheet cutting and conveying mechanism according to the second embodiment. The conveying roller pair R4 changes in speed depending on the length Ln of the cut product SHc. First, in step S2001, the leading edge SH1 of a sheet conveyed next is detected by the edge sensor SE4 disposed upstream of the conveying roller pair R4. The length Ln of the cut product SHc is obtained at the detection timing, and the length Ln is compared with a constant to determine the conveying speed.

If the length Ln is larger than the distance Lr4 from the first cutter C1 to the nip of the conveying roller pair R4 in step S2003, the conveying roller pair R4 moves to step S2004 and is driven at the upstream conveying speed Vp to convey the yet-to-be-cut continuous sheet SHr.

If the length Ln is smaller than or equal to Lr4, the conveying roller pair R4 nips the sheet during cutting, and after the cutting, moves to step S2007, in which it conveys the cut product SHc from the state at the high running speed Vh. In step S2009, the conveying roller pair R4 halts at the cutting position of the second cutter C2, and in step S2010, conveys a specified feed at the high running speed Vh. The feed at the speed Vh in step S2010 is set to (Lr4−Lc2+x) that is obtained by adding a margin x corresponding to the apparatus to the distance (Lr4−Lc2) from the second cutter C2 to the nip of the conveying roller pair R4 to reliably convey the cut product SHc until the product SHc is separated from the nip of the conveying roller pair R4.

After the conveyance at the speed Vh, the conveying roller pair R4 returns to detection step S2001 of the edge sensor SE4.

Figure 23:
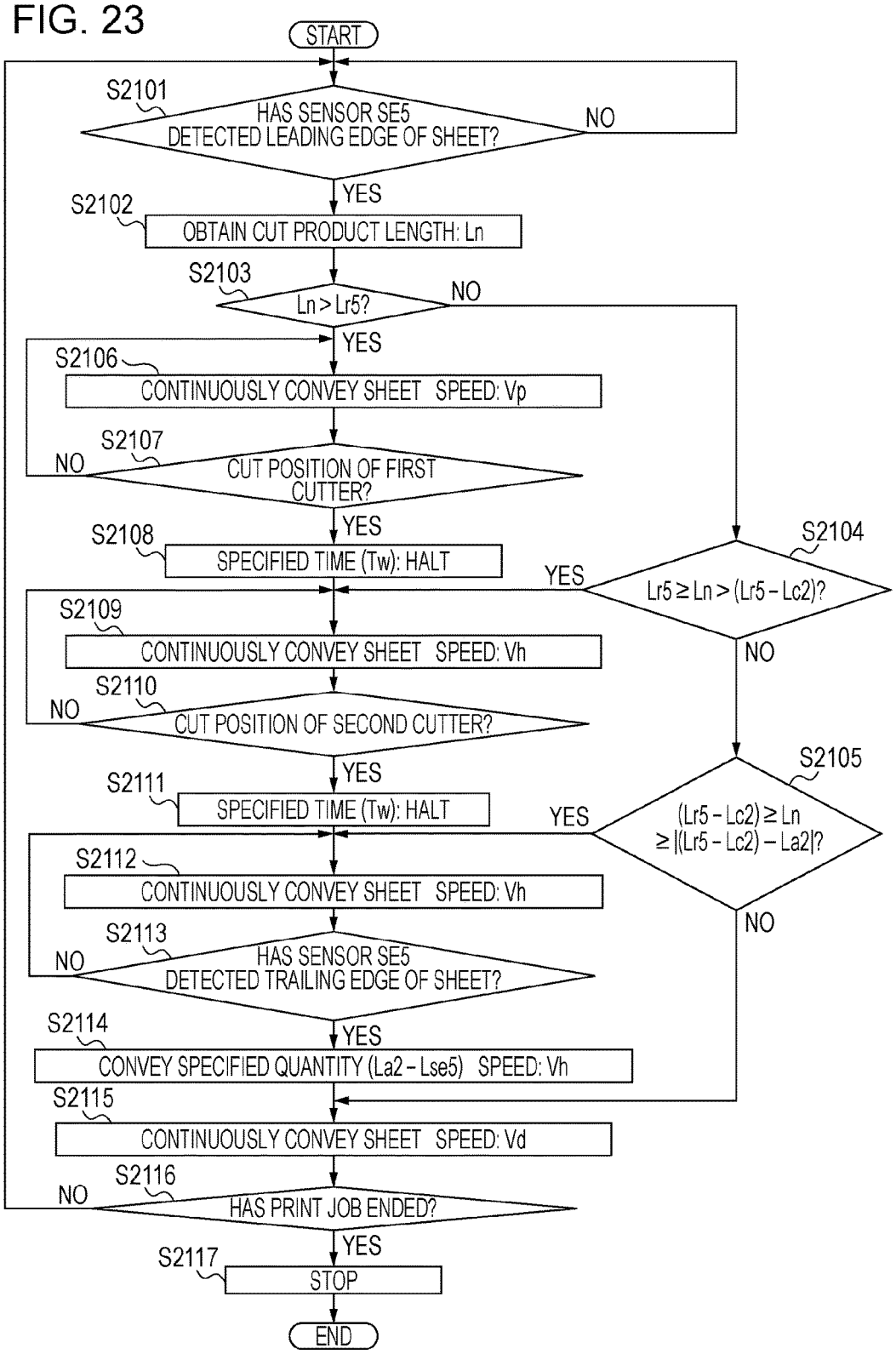
FIG. 23 is a flowchart of the operation of a conveying roller pair R5 of the sheet cutting and conveying mechanism according to the second embodiment.

FIG. 23 is a flowchart of the operation of the conveying roller pair R5 of the sheet cutting and conveying mechanism according to the second embodiment. The conveying roller pair R5 also changes in speed depending on the length Ln of the cut product SHc. First, in step S2101, the leading edge SH1 of a sheet conveyed next and disposed upstream of the conveying roller pair R5 is detected by an edge sensor SE5. The length Ln of the cut product SHc is obtained in step S2102 next to the detection timing, and the length Ln is compared with a constant to determine the conveying speed.

In step S2103, the length Ln and the distance Lr5 from the first cutter C1 to the nip of the conveying roller pair R5 are compared. If the length Ln is larger than the distance Lr5 from the first cutter C1 to the nip of the conveying roller pair R5, the conveying roller pair R5 moves to step S2106 and is driven at the upstream conveying speed Vp to convey the yet-to-be-cut continuous sheet SHr.

If the length Ln is smaller than a value obtained by subtracting the feed (La2) at the high running speed Vh from the distance (Lr5–Lc2) from the second cutter C2 to the nip of the conveying roller pair R5, that is, {(Lr5–Lc2)–La2}, the conveying roller pair R5 moves to step S2115. In this case, the conveying roller pair R5 conveys the cut product SHc at the downstream conveying speed Vd.

If the length Ln is smaller than or equal to the distance Lr5 from the first cutter C1 to the nip of the conveying roller pair R5 and larger than the distance (Lr5–Lc2) from the second cutter C2 to the nip of the conveying roller pair R5, the conveying roller pair R5 moves to step S2109. In step S2109, the conveying roller pair R5 conveys the cut product SHc that is cut by the first cutter C1 to the second cutter C2 at the high running speed Vh.

If the length Ln is larger than or equal to {(Lr5–Lc2)–(La2)} and smaller than or equal to the distance (Lr5–Lc2) from the second cutter C2 to the nip of the conveying roller pair R5, the conveying roller pair R5 moves to step S2112. In step S2112, the conveying roller pair R5 conveys the cut product SHc that is cut by the second cutter C2 at the high running speed Vh. The cut product SHc is conveyed by (La2–Lse5) at the conveying speed Vh after the timing at which the edge sensor SE5 has detected the trailing edge SH2 of the cut product SHc, and then the conveying speed Vh shifts to the downstream constant speed Vd.

Figure 24:
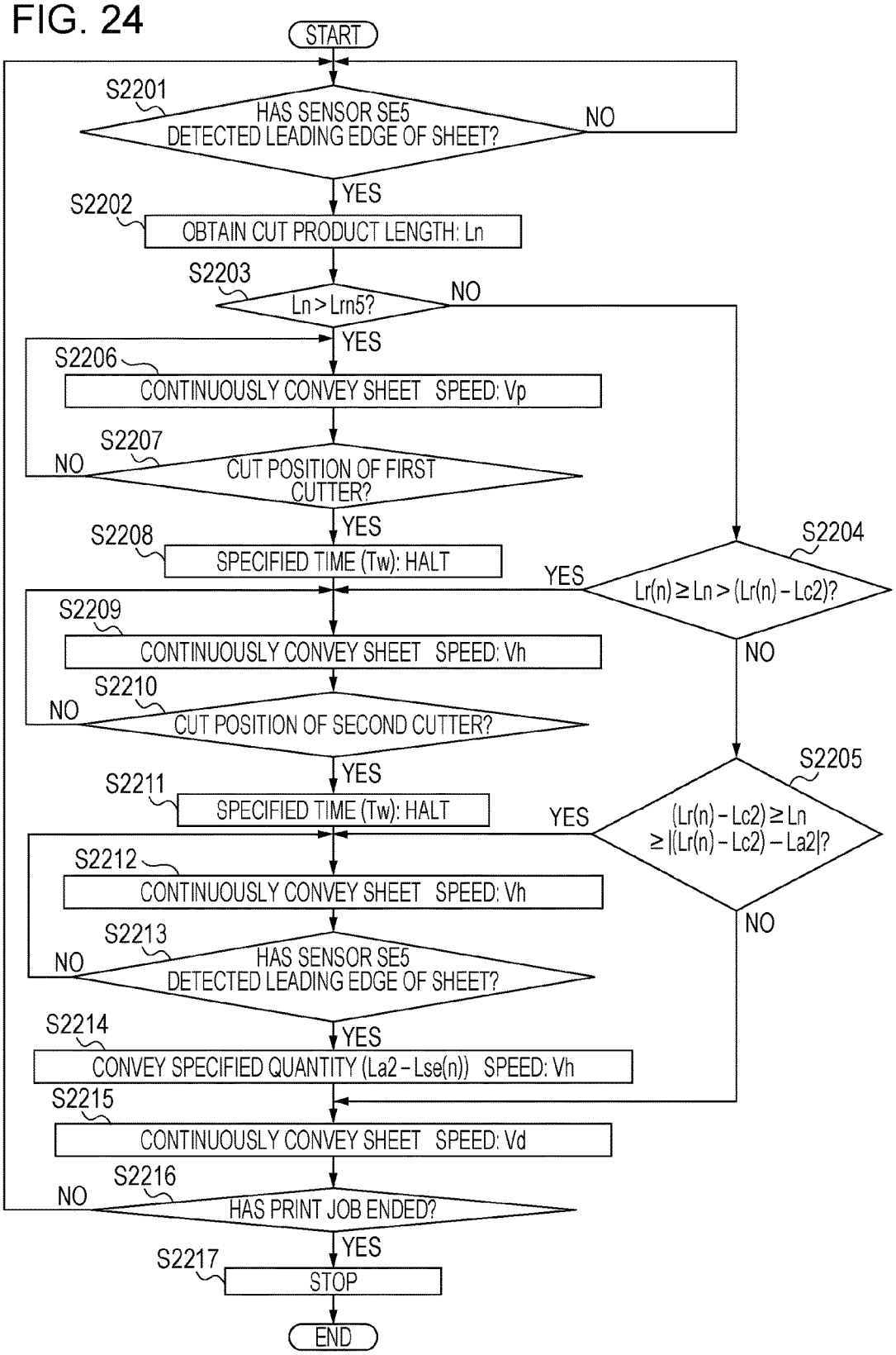
FIG. 24 is a flowchart of the operation of conveying roller pairs R(N) following the fifth conveying roller pair of the sheet cutting and conveying mechanism according to the second embodiment.

FIG. 24 is a flowchart of the operation of the conveying roller pair R(N) of the sheet cutting and conveying mechanism according to the second embodiment. If the length Ln of the cut product SHc is large, edge sensors SE(N) and conveying roller pairs R(N) are added to the downstream side at a constant pitch. A sequence similar to that in FIG. 23 can be applied only by changing steps S2201, S2203, S2204, S2205, and S2214.

Both the first and second embodiments may also be provided with a sheet guide member at the sheet conveying path. Although the conveying path is straight in the drawings, it may be curved, and the number of independently driven conveying roller pairs may be increased depending on the cutting length of the product.

While the present invention has been described with reference to exemplary embodiments, it is to be understood that the invention is not limited to the disclosed exemplary embodiments. The scope of the following claims is to be accorded the broadest interpretation and encompass, among other things, all modifications and equivalent structures and functions.

What is claimed is:

1. A sheet cutting apparatus comprising:

a first conveying unit that conveys a sheet;

an upstream conveying unit that is disposed upstream of the first conveying unit in a conveying direction and that conveys the sheet at a first conveying speed;

a cutting unit that is disposed downstream of the first conveying unit in the conveying direction and that cuts the sheet;

a second conveying unit that is disposed downstream of the cutting unit in the conveying direction and that conveys the sheet;

a third conveying unit that is disposed downstream of the second conveying unit and that conveys the sheet;

a detecting unit that is disposed between the second conveying unit and the third conveying unit and that detects the sheet; and a determination unit configured to determine whether the third conveying unit is nipping the sheet during cutting of the sheet, wherein the first conveying unit and the second conveying unit convey the sheet at the first conveying speed before the sheet reaches a cutting position;

wherein, the cutting unit cuts the sheet into a downstream part and an upstream part in a state in which the first conveying unit and the second conveying unit are stopped and the upstream conveying unit is conveying the sheet at the first conveying speed; and wherein, after the sheet is cut, the second conveying unit conveys the downstream part of the sheet at a second conveying speed higher than the first conveying speed, after the sheet is cut, the first conveying unit conveys the upstream part of the sheet at a conveying speed higher than the first conveying speed to reduce the slack of the upstream part of the sheet, formed between the upstream conveying unit and the first conveying unit during a state in which the first conveying unit and the second conveying unit are stopped; and in a case where the determination unit determines that the third conveying unit is nipping the sheet during cutting of the sheet, after the detecting unit detects the sheet and before the cutting unit cuts the sheet, the third conveying unit conveys the sheet at the first conveying speed, and after the cutting unit cuts the sheet, the third conveying unit conveys the downstream part of the sheet at the second conveying speed higher than the first conveying speed, and in a case where the determination unit determines that the third conveying unit is not nipping the sheet during cutting of the sheet, after the detecting unit detects the sheet, the third conveying unit does not convey the sheet at the first speed, but conveys the sheet at the second speed wherein said sheet cutting apparatus further comprises a second cutting unit between the second conveying unit and the third conveying unit, wherein a portion to be discharged of the downstream part of the sheet that is cut by the cutting unit is cut by the second cutting unit.

2. The sheet cutting apparatus according to claim 1, further comprising an acquisition unit that acquires a cutting length of the sheet, wherein the determination unit determines that the third conveying unit is nipping the sheet during cutting of the sheet, in a case where the cutting length acquired by the acquisition unit is equal to or larger than a distance from the cutting unit to a nip of the third conveying unit, wherein the determination unit determines that the third conveying unit is not nipping the sheet during cutting of the sheet, in a case where the cutting length acquired by the acquisition unit is smaller than the distance from the cutting unit to the nip of the third conveying unit.

3. The sheet cutting apparatus according to claim 1, wherein the third conveying unit conveys the downstream part of the sheet at the second conveying speed, after the sheet stops at a cutting position of the second cutting unit.

4. The sheet cutting apparatus according to claim 1, wherein after the sheet is cut, the second conveying unit conveys the downstream part of the sheet at the second conveying speed during a state in which the upstream conveying unit is conveying the upstream part of the sheet at the first conveying speed, and after the sheet is cut, the first conveying unit conveys the upstream part of the sheet at the conveying speed higher than the first conveying speed to reduce the slack of the upstream part of the sheet, formed between the upstream conveying unit and the first conveying unit during stopping of the first conveying unit and the second conveying unit, during a state in which the upstream conveying unit is conveying the upstream part of the sheet at the first conveying speed.

5. The sheet cutting apparatus according to claim 1, wherein the third conveying unit conveys the downstream part of the sheet at a third conveying speed that is suitable for a subsequent process in a case where the determination unit determines that the third conveying unit is not nipping the sheet during cutting of the sheet and the length of the downstream part of the sheet is smaller than a difference between the distance from the cutting unit to the nip of the third conveying unit and a predetermined distance, and wherein the third conveying unit conveys the downstream part of the sheet at the second conveying speed in a case where the determination unit determines that the third conveying unit is not nipping the sheet during cutting of the sheet and a length of the downstream part of the sheet is larger than a difference between the distance from the cutting unit to the nip of the third conveying unit and the predetermined distance.

6. The sheet cutting apparatus according to claim 1, wherein the determining unit determines whether the third conveying unit is nipping the sheet during cutting of the sheet based on length information in the conveying direction of the downstream part of the sheet that is cut by the cutting unit and the distance from the cutting unit to the nip of the third conveying unit.

7. The sheet cutting apparatus according to claim 1, wherein the first conveying unit conveys the upstream part of the sheet at the first conveying speed after conveying the upstream part of the sheet at the conveying speed higher than the first conveying speed to reduce the slack of the upstream part of the sheet.

8. The sheet cutting apparatus according to claim 1, wherein the second conveying unit conveys the upstream part of the sheet at the first conveying speed after eliminating the slack of the upstream part of the sheet.

9. The sheet cutting apparatus according to claim 1, wherein the third conveying unit conveys the downstream part of the sheet at a third conveying speed that is suitable for a subsequent process after conveying at the second conveying speed.

10. The sheet cutting apparatus according to claim 1, further comprising a printing unit that prints an image on the sheet.

11. The sheet cutting apparatus according to claim 1, further comprising a fourth conveying unit that is disposed downstream of the third conveying unit and that conveys the sheet; and a second detecting unit that is disposed between the third conveying unit and the fourth conveying unit and that detects the sheet; and wherein in a case where the determination unit determines that the third conveying unit is nipping the sheet during cutting of the sheet, after the second detecting unit detects the sheet and before the cutting unit cuts the sheet, the fourth conveying unit conveys the sheet at the first conveying speed, and after the cutting unit cut the sheet, the fourth conveying unit conveys the downstream part of the sheet at the second conveying speed higher than the first conveying speed, and in a case where the determination unit determines that the third conveying unit is not nipping the sheet during cutting of the sheet, after the second detecting unit detects the sheet, the fourth conveying unit does not convey the sheet at the first speed, but conveys the sheet at the second speed.

12. The sheet cutting apparatus according to claim 11, wherein the third conveying unit conveys the downstream part of the sheet at a third conveying speed corresponding to a subsequent process in a case where the fourth conveying unit is not nipping the sheet during cutting of the sheet and the length of the downstream part of the sheet is smaller than a difference between the distance from the cutting unit to the nip of the fourth conveying unit and a second predetermined distance, wherein the third conveying unit conveys the downstream part of the sheet at the second conveying speed in a case where the fourth conveying unit is not nipping the sheet during cutting of the sheet and a length of the downstream part of the sheet is larger than a difference between the distance from the cutting unit to the nip of the fourth conveying unit and the second predetermined distance.

13. The sheet cutting apparatus according to claim 11, wherein the fourth conveying unit conveys the downstream part of the sheet at a third conveying speed corresponding to a subsequent process after conveying at the second conveying speed.

14. A sheet cutting method for controlling an apparatus comprising a first conveying unit that conveys a sheet; an upstream conveying unit that is disposed upstream of the first conveying unit in a conveying direction and that conveys the sheet at a first conveying speed; a cutting unit that is disposed downstream of the first conveying unit in the conveying direction and that cuts the sheet; a second conveying unit that is disposed downstream of the cutting unit in the conveying direction and that conveys the sheet; a third conveying unit that is disposed downstream of the second conveying unit and that conveys the sheet; a detecting unit that is disposed between the second conveying unit and the third conveying unit and that detects the sheet; and a determination unit configured to determine whether the third conveying unit is nipping the sheet during cutting of the sheet, the sheet cutting method comprising:

causing the first conveying unit and the second conveying unit to convey the sheet at the first conveying speed before the sheet reaches a cutting position;

causing the cutting unit to cut the sheet into a downstream part and an upstream part in a state in which the first conveying unit and the second conveying unit are stopped and the upstream conveying unit is conveying the sheet at the first conveying speed; and after the sheet is cut, causing the second conveying unit to convey the downstream part of the sheet at a second conveying speed higher than the first conveying speed, after the sheet is cut, causing the first conveying unit to convey the upstream part of the sheet at a conveying speed higher than the first conveying speed to reduce the slack of the upstream part of the sheet, formed between the upstream conveying unit and the first conveying unit during a state in which the first conveying unit and the second conveying unit are stopped; and in a case where the determination unit determines that the third conveying unit is nipping the sheet during cutting of the sheet, after the detecting unit detects the sheet and before the cutting unit cuts the sheet, causing the third conveying unit to convey the sheet at the first conveying speed, and after the cutting unit cuts the sheet, causing the third conveying unit to convey the downstream part of the sheet at the second conveying speed higher than the first conveying speed, and in a case where the determination unit determines that the third conveying unit is not nipping the sheet during cutting of the sheet, after the detecting unit detects the sheet, causing the third conveying unit not to convey the sheet at the first speed, but to convey the sheet at the second speed wherein said apparatus further comprises a second cutting unit between the second conveying unit and the third conveying unit, wherein a portion to be discharged of the downstream part of the sheet that is cut by the cutting unit is cut by the second cutting unit.

* * * * *